US011821712B2

(12) United States Patent
Terry et al.

(10) Patent No.: US 11,821,712 B2
(45) Date of Patent: Nov. 21, 2023

(54) PROJECTILE STABILIZERS, PROJECTILES WITH STABILIZERS, AND METHODS OF MANUFACTURING

(71) Applicants: Brian Terry, Buchanan, MI (US); Steven Terry, Buchanan, MI (US); Brandon Cummings, Three Oaks, MI (US)

(72) Inventors: Brian Terry, Buchanan, MI (US); Steven Terry, Buchanan, MI (US); Brandon Cummings, Three Oaks, MI (US)

( * ) Notice: Subject to any disclaimer, the term of this patent is extended or adjusted under 35 U.S.C. 154(b) by 209 days.

(21) Appl. No.: 17/198,010

(22) Filed: Mar. 10, 2021

(65) Prior Publication Data

US 2021/0302140 A1 Sep. 30, 2021

Related U.S. Application Data

(60) Provisional application No. 62/994,190, filed on Mar. 24, 2020.

(51) Int. Cl.

| | |
|---|---|
| ***F42B 10/08*** | (2006.01) |
| ***F42B 10/04*** | (2006.01) |
| ***F42B 6/00*** | (2006.01) |

(52) U.S. Cl.

CPC ..... *F42B 10/08* (2013.01); *F42B 6/003* (2013.01); *F42B 10/04* (2013.01)

(58) Field of Classification Search

CPC ..... F42B 6/003; F42B 10/04

See application file for complete search history.

(56) References Cited

U.S. PATENT DOCUMENTS

| | | | | |
|---|---|---|---|---|
| 2015/0113782 | A1* | 4/2015 | Blosser | F42B 6/06 29/280 |
| 2016/0231092 | A1* | 8/2016 | Hamazaki | F42B 6/003 |
| 2020/0025538 | A1* | 1/2020 | Hill | F42B 6/06 |

* cited by examiner

*Primary Examiner* — J. Woodrow Eldred

(74) *Attorney, Agent, or Firm* — Vitale Vickrey Niro & Gasey

(57) ABSTRACT

A projectile and stabilizer therefor are provided. The sliding stabilizer is used instead of fixed or glued tail feathers, vanes or other fletching as a means for stabilizing projectile flight. The invention improves current projectile technology with reduced assembly labor cost, the elimination of bow clearance issues, improved accuracy with the consistent production of the sliding stabilizer, easy replacement of the stabilizer in the field, and improved projectile storage. A sliding stabilizer is designed to slide along the shaft of a projectile and comprises a circumferentially extending wing and a plurality of fins. In use, the stabilizer is positioned at the front of the projectile prior to launch, and the projectile slides quickly through the stabilizer until secured at a stop position at or near the trailing end of the projectile. An annular arrow fletch and arrow stabilizer are also provided. The annular arrow fletch may be used for; stabilizing arrow flight, providing better clearance and functionality then conventional fixed glued tail feathers. A stabilizer may be used with light emitting diode arrow nocks. The stabilizer may improve arrow shaft stabilization technology with reduced assembly labor cost, the elimination of facial and or face mask interference issues providing more clearance, improved accuracy, repeatable production with the consistent injection mold production of the annular arrow fletch, easy replacement of the annular arrow fletch in the field, and improved arrow storage. An annular arrow fletch may incorporate a metallic contact point, which will work with all light emitting nocks. A design of an annular arrow fletch may be affixed to an arrow by an arrow nock and may (Continued)

comprise an annular wing, a central elongated cylindrical cylinder with a cap and a plurality of fins with micro-groves and a metal contact. In use, the annular arrow fletch is affixed at the aft end of the arrow by an arrow nock prior to launch.

19 Claims, 22 Drawing Sheets

1700b

1713b

What Type of Zinger Should I choose?

Z3: slightly lighter, faster, less stabilization, increased fletching clearance, less wind drift, traditional look and style.

Z4: slightly heavier, slower, greater stabilization, reduced fletching clearance, more wind drift, modern look and style.

1714b

What Degree Offset Is Right For Me?

1 Degree: less stabilization, faster speed, works with all rests, recommended for smaller mechanical broadheads and field points.

3 Degree: moderate stabilization, moderate speed, works with all rests, recommended for smaller fixed broadheads, all mechanicals, and field points.

6 Degree: more stabilization, slower speed, works best with drop away rests, highly recommended for fixed broadheads, all mechanicals and field points.

1715b

Should I Choose A Left Offset Or Right Offset?

Left Offset: has a counter-clockwise rotation from the archers point of view and often tends to loosen the tips of your arrow after impact with a target or game species.

Right Offset: has a clockwise rotation from the archers point of view and is the more common choice between the two.

1716b

So why Choose A Left Offset If It Loosens Tips?

-After bareshaft tuning, some archers notice a counter-clockwise rotation of their arrow shaft and choose to stick with the natural rotation and opt for a Left Offset.

-If using single bevel broadheads, you want to match the offset.

*Example: left bevel broadhead = left offset*

Fig. 17B

1717c

1700c

Zinger Test Pack!!!

*Don't know exactly which type of Zinger fletch to purchase?*

Now you can find the perfect fletch for your specific setup by purchasing the Zinger Test Pack for you to field test before making a large purchase. You pick the color and offset and give us your arrow O.D. , arrow make, model and spine.

* A 6 pack will come with the following: A Z3, and Z4 Zinger fletch in each of the degree offsets (1, 3, and 6).

** A 12 pack will come with the following: Two Z3, and Z4 Zinger fletches in each of the degree offsets (1, 3, and 6).

Order A Test Pack Here:

1718c

Quantity (6) 1 of each type $13.50 USD

1719c

Color

Pink

1720c

Offset Orientation

Right Offset

1721c

O.D. Of Arrow Shaft

1722c

Arrow Make, Model And Spine

1725c

Add to Cart

Fig. 17C

1700d

NEW! Zinger Glow Strips

1723d

Brighten up any arrow setup with our Zinger Glow Strips. Just a few minutes of sun exposure and you'll have a glow strip on your arrow that glows for hours! Makes your arrow more visible during flight and easier to find after a pass through. Each Glow strip will be approximately 6.5" and should accomodate a half dozen of most arrow shafts. Most arrows will need between .75" and 1.25" per arrow of Glow Strip material and weigh between 1.5 and 3 grains each depending on outside arrow diameter.

Quantity change may be made before purchasing in your cart

1725d

Add to Cart

Fig. 17D

PROJECTILE STABILIZERS, PROJECTILES WITH STABILIZERS, AND METHODS OF MANUFACTURING

CROSS-REFERENCE TO RELATED APPLICATION

The present application claims priority to U.S. Provisional Patent Application Ser. No. 62/994,190, filed Mar. 24, 2020, entitled PROJECTILE STABILIZERS, PROJECTILES WITH STABILIZERS, AND METHODS OF MANUFACTURING, the entire disclosure of which is incorporated herein by reference thereto.

TECHNICAL FIELD

This disclosure is generally related to stabilizers for a projectile (e.g., self-propelled projectiles, crossbow bolts, spears, javelins, jarts, blowgun darts, throwing darts, arrows, toy rockets, toy projectiles etc.), and more particularly, to a stabilizer for the flight of a projectile.

BACKGROUND

Projectiles typically are fletched on the rear of a projectile shaft to provide flight stability. Usually, three or four fletches are mounted in a circumferentially spaced relationship. The practice of using multiple pieces or individual fletches has remained virtually unchanged over time, wherein each fletch or vane must be glued in place separately, either by hand, or with the aid of a tool or fletching jig. This process is time consuming and introduces inconsistencies in spacing and angles. Minute inconsistencies in the form of unevenly spaced fletching, varying distances from the end of the projectile shaft, and angular variations have a profound effect on the flight of a projectile.

Furthermore, polluting and toxic chemicals are often required to clean the projectile shaft prior to gluing. Moreover, conventionally fletched projectiles are easily damaged in the field or while in storage. When damaged, conventional fletching is normally not considered field replaceable and can be difficult to repair.

Finally, prior art stabilizing methods require the fletching to pass over and/or through the projectile rest causing possible interference with the rest, thus imposing certain design limitations. Projectile rests may interfere with the flight of a projectile through inadvertent contact therewith, thereby adversely affecting flight performance, as well as damaging the fletching through such contact. While fall-away or offset rests must often be used to reduce the incidence of contact between the projectile rest and the fletching of a projectile, such rests can be expensive and do not resolve other above-mentioned problems associated with fletching.

U.S. Pat. No. 5,951,419 to Cameneti addresses the above mentioned fletching inconsistency issue by teaching a single-piece fletching mounted on the rear portion of the shaft of the projectile, wherein the fletching comprises a flared cone projecting rearward and outward, giving the fletching a funnel-shaped appearance. Deficiencies of this solution, however, include a significantly increased drag problem, excessive length, and failure to resolve the interference problem.

"Fletching" is a generic term used to describe the fins of a projectile that guide and stabilize the projectile during flight. These fins, when made from natural feathers, are commonly referred to collectively as "fletching", comprising individual "fletches." When made from plastic or other man-made materials, these fins are called "vanes." In the present application, the terms "fletching," "feathers," "vanes," and "fins" are employed throughout when describing fins of any type and are used interchangeably.

"Nock" is a generic term used to describe the portion of the projectile that secures the projectile in place before launch, typically by surrounding the bowstring with a notched area.

"Stop" is a term that may be used herein for a device for securing a stabilizer consistent with the present invention onto a projectile or a component thereof.

"Projectile rest" is typically the term for a small protrusion or device on the bow at the point where the projectile will rest during the draw, to hold the projectile away from and reduce contact with the riser (the thick, non-bending center portion of the bow).

"Cap" is a term that may be used herein as part of the annular arrow fletch device, which limits the annular arrow fletches depth onto the arrow shaft. This part of the device allows the annular arrow fletch only to be recessed onto an arrow shaft to a predetermined depth.

A "fall-away rest" is an arrow rest that holds the arrow with an element that "falls away," drops, or otherwise travels away from the arrow when the string is released and the arrow is launched, thereby reducing or eliminating contact between the arrow rest and portions of the arrow itself, e.g., shaft or fletching.

"Mechanical Release" is a devise used by archers to release the bowstring. There are numerous varieties of mechanical releases. Generally the mechanical release is held in the archer's hand and he/she would attach the mechanical release to the bowstring, the arrow is loaded onto the string and the arrow rest. The archer would then pull the bowstring rearward and the mechanical release has a trigger to release the bowstring launching the arrow.

"Lighted nocks" are a light emitting arrow nock, which contain a battery, L.E.D. light emitting diode, and an arrow nock. The lighted nock may or may not have a switch. The lighted nock's intended use is to emit light from the nock after the arrow is shot from the bow.

SUMMARY

The present disclosure provides a stabilizer, a projectile, and related archery tools incorporating a novel aerodynamic design for projectiles having a variety of general or specialized uses. This improvement is achieved by elimination of conventional fixed tail feathers and the use of a stabilizer consistent with the present invention.

The improved stabilizer of the present invention may be used for a projectile or other projectile and resolves prior art issues related to clearances, fletching inconsistency, environmental sensitivity, field replaceability, and excessive drag. A stabilizer consistent with the present invention comprises a unit adapted to slide along the shaft of a projectile, which is mounted on the leading end of the projectile until the projectile is propelled from the bow, at which time the stabilizer travels to the trailing end of the projectile and is secured at a predetermined location along the shaft, as the projectile travels beyond the rest and bow. A stop adapted to prevent further rearward travel of the stabilizer during the flight of the projectile may be integral to the shaft or nock, or alternatively may be a separate unit adapted to mate with the shaft or nock of a projectile.

The present invention provides a field replaceable sliding stabilizer that eliminates the inconsistencies and costs associated with traditional multi-piece glue on fletching systems. Further, a projectile comprising a stabilizer consistent with the present invention eliminates interference at the projectile rest caused by conventional fletching and a conventional bow.

A stabilizer consistent with the present invention may easily be mass-produced and is capable of providing high accuracy devices with highly repetitive results in use. Such a stabilizer may comprise a plurality of projections or "fingers" that aid in the operation of the stabilizer by creating a friction or interference fit between the projectile shaft and the stabilizer during slideable engagement therebetween. A stabilizer consistent with the present invention may be particularly shaped or otherwise adapted to provide additional aerodynamic features (e.g., impact force on the target or other such flight characteristics). Further, two or more stabilizers may be disposed along the shaft of a projectile (e.g., at the forward tip to prevent instability caused by the use of exotic or poorly balanced projectiles).

Further, the present invention provides a projectile having improved aerodynamic characteristics, resulting in increased flight stability, speed, and accuracy. A projectile consistent with the present invention requires no feathers or traditional fletching, instead utilizing a sliding aerodynamic stabilizer that is slid or mounted over the front or rear of the projectile shaft, and the projectile travels through the stabilizer until it is positioned on the projectile at a provided stop, after which the stabilizer flies the projectile in a conventional manner. Since a projectile consistent with the present invention may comprise a short cross section, flight stability is less impacted by cross wind drift and wobble. Further, since the projectile requires no fixed fletching attached thereto, the projectile may have a higher acceleration rate due to a reduced mass that has to be initially accelerated by the bow.

BRIEF DESCRIPTION OF THE DRAWINGS

FIGS. 17A-D depict example user interfaces associated with stabilizer ecommerce.

DETAILED DESCRIPTION

Figure 1A:
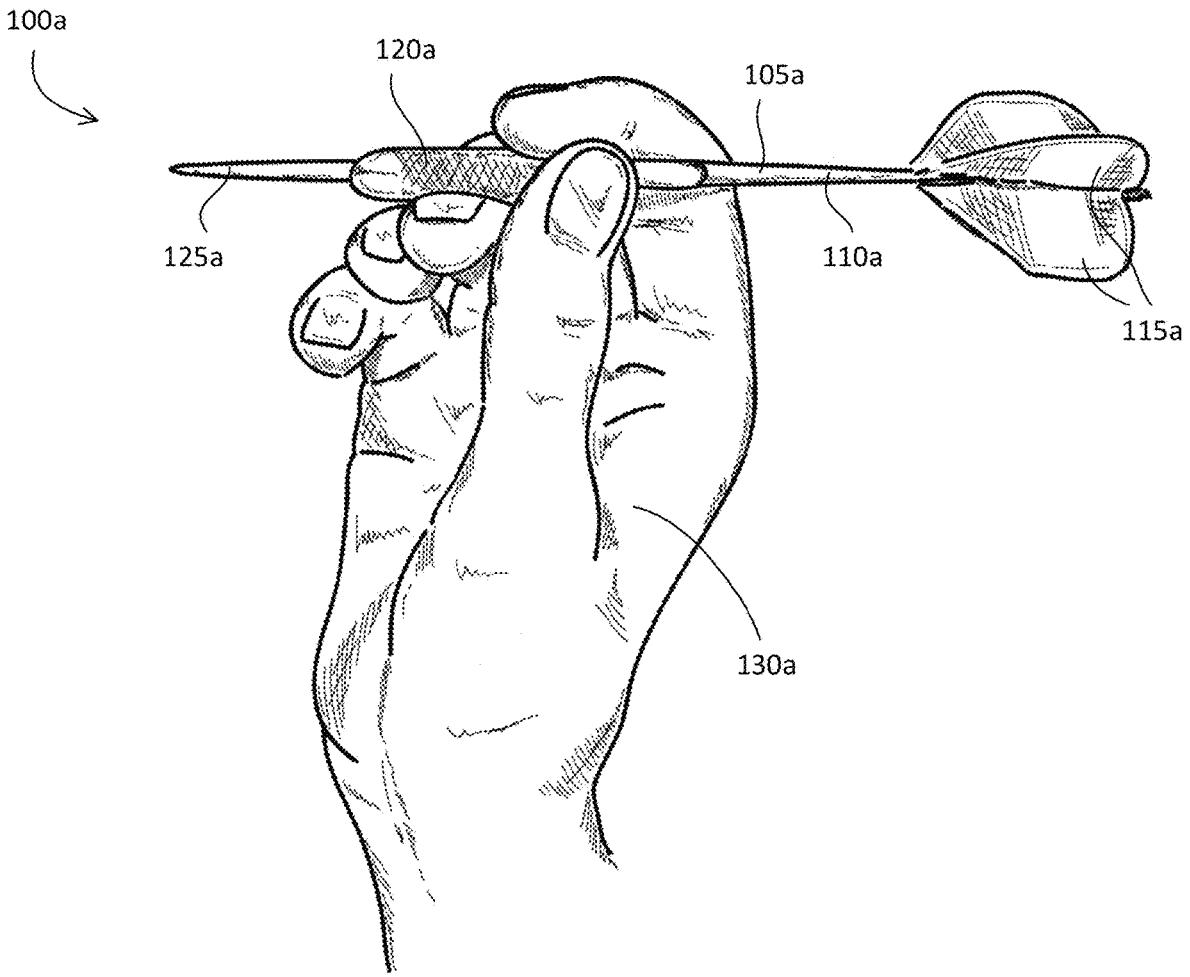
FIGS. 1A and 1B depict an example dart having a stabilizer.
Figure 1B:
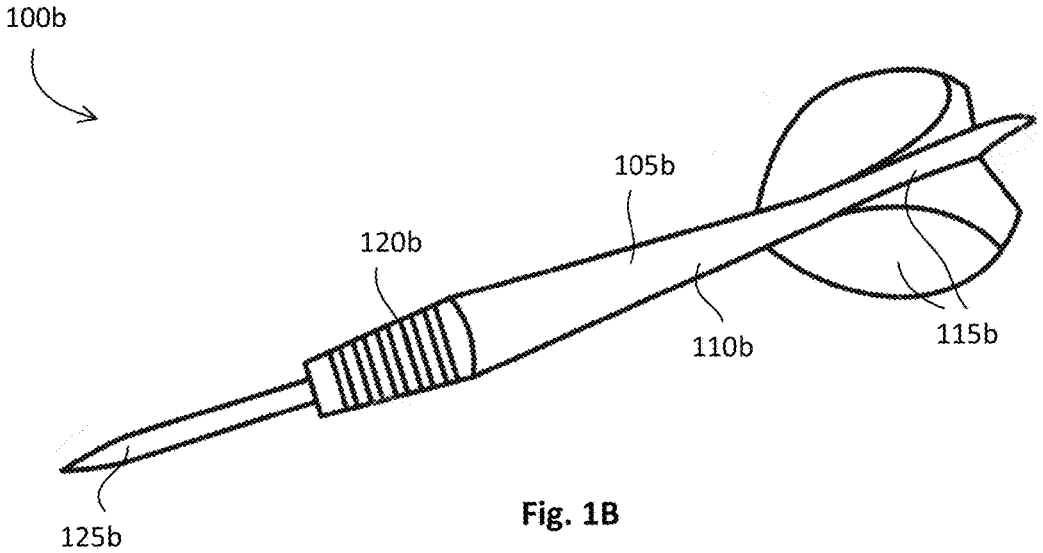

Turning to FIGS. 1A and 1B, a projectile 100*a,b* may be configured as, for example, a dart 105*a,b*. The dart 105*a,b* may include: a shaft 110*a,b*, a stabilizer 115*a,b*, a grip 120*a,b*, and a tip 125*a,b*. A typical stabilizer may include fin fixed to the shaft (e.g., by gluing), and may be easily damaged or lost through contact with other surfaces (e.g., with hand 130*a* used to launch the projectile 100*a,b*), with butt material (backing, bales, or dirt designed to stop and hold projectiles) of a paper target, or with a game animal.

Figure 2:
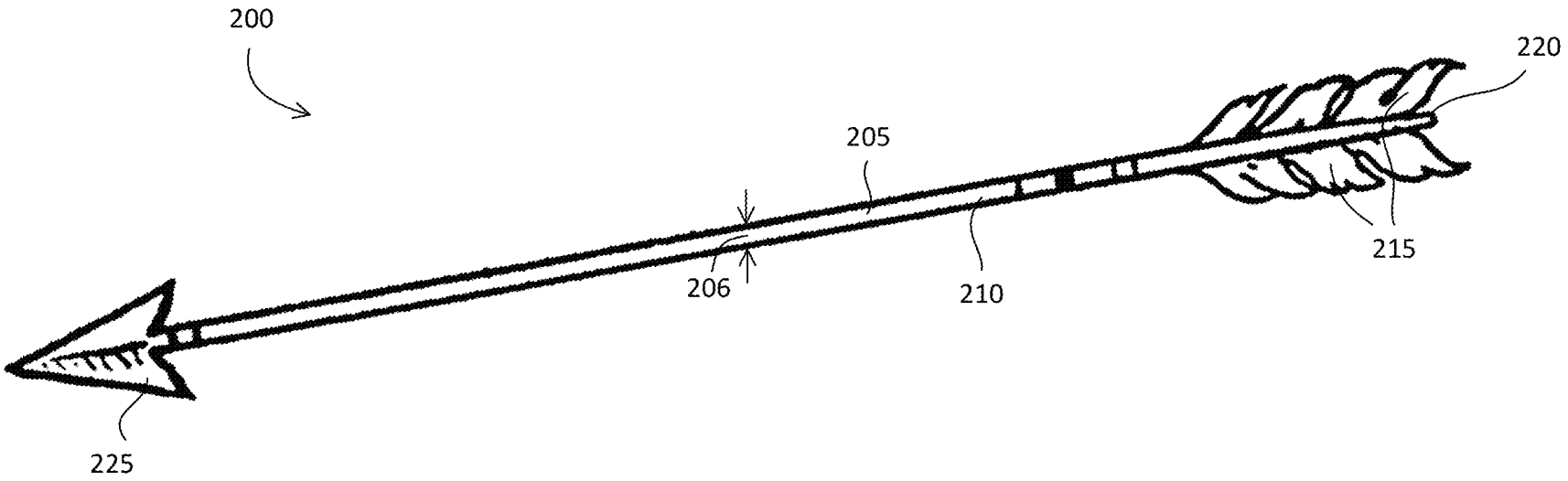
FIG. 2 depicts an example cross bow bolt having a stabilizer.
Figure 3A:
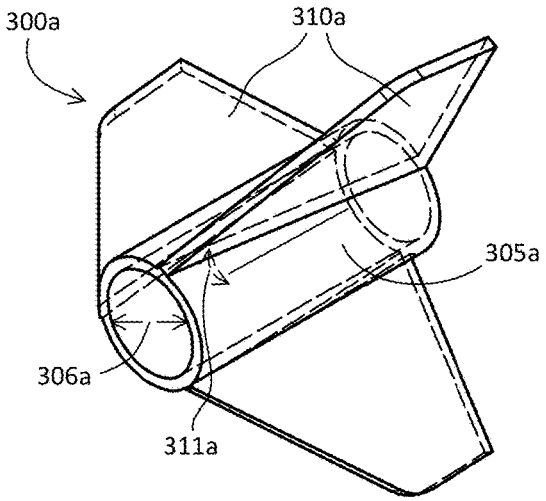
FIGS. 3A-D depict an example projectile stabilizer.
Figure 3C:
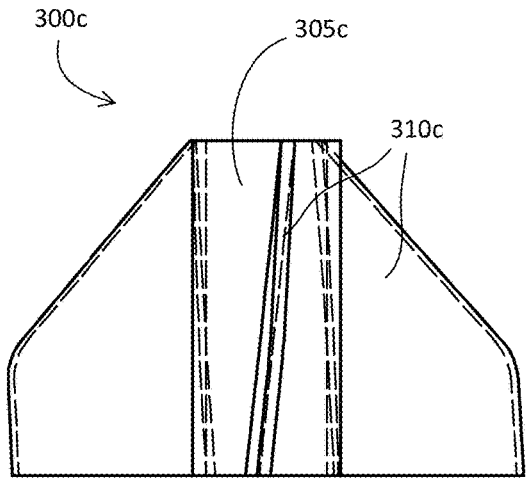
Figure 3D:
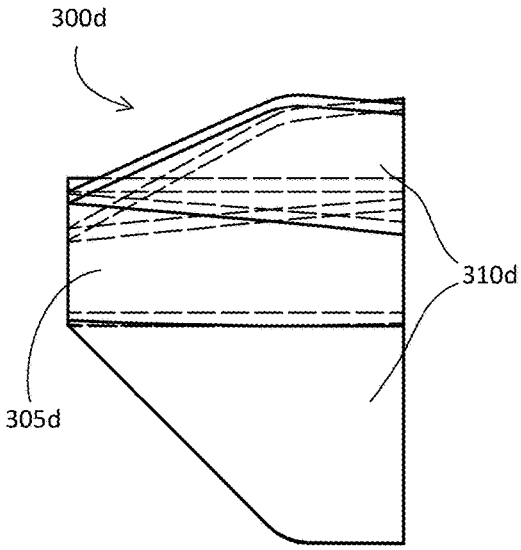
Figure 3B:
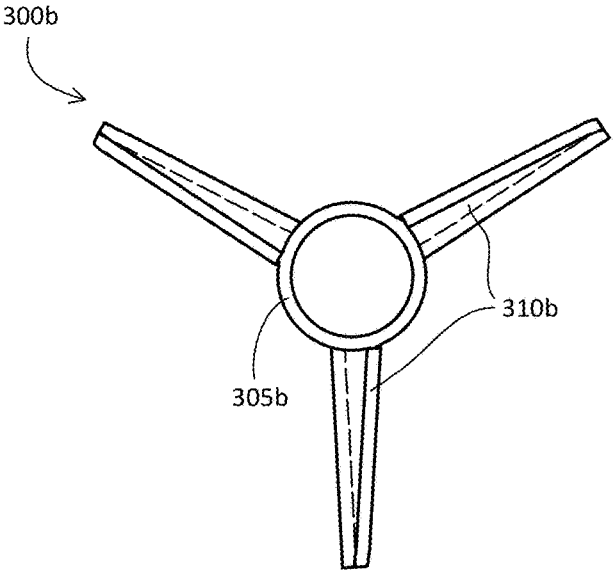
Figure 4A:
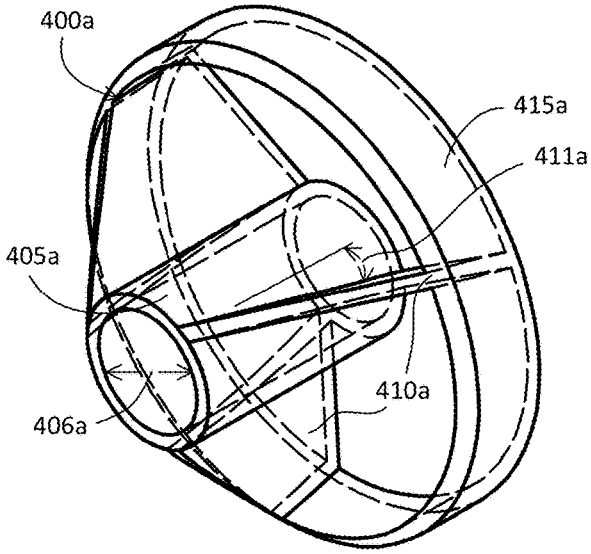
FIGS. 4A-D depict an example projectile stabilizer having a circumferentially extending wing.
Figure 4C:
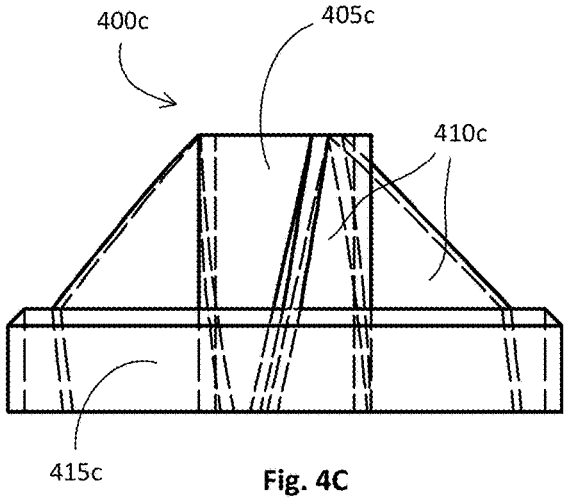
Figure 4D:
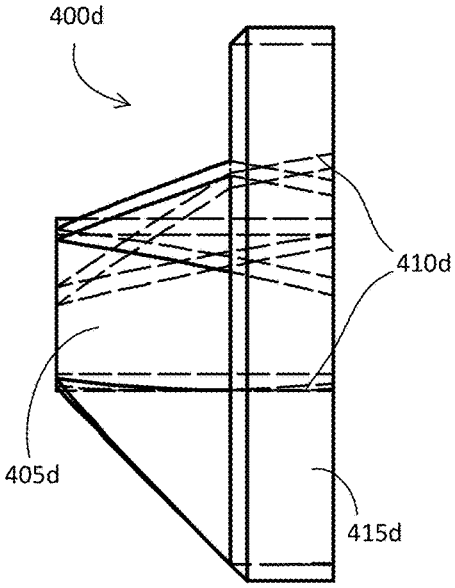
Figure 4B:
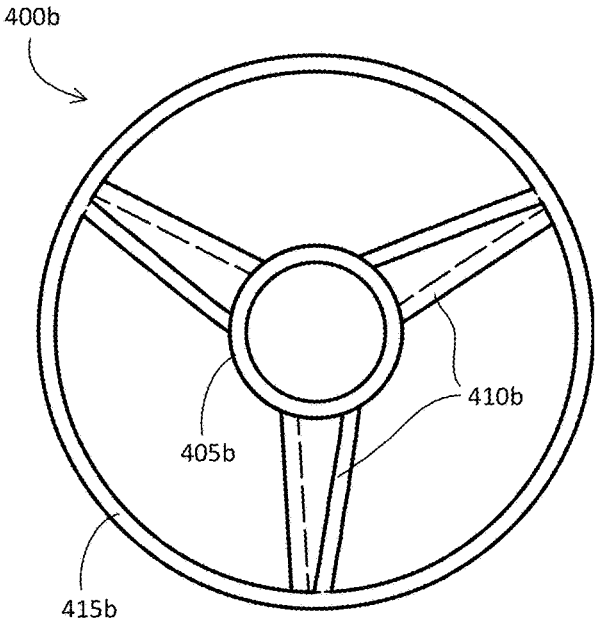
Figure 5A:
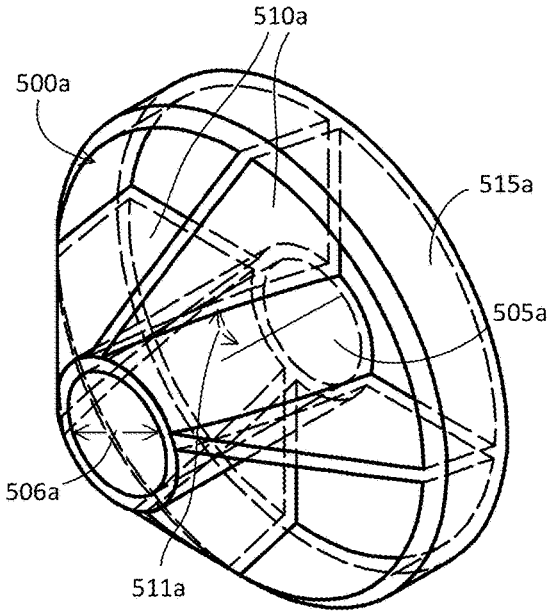
FIGS. 5A-D depict an example projectile stabilizer having a circumferentially extending wing.
Figure 5C:
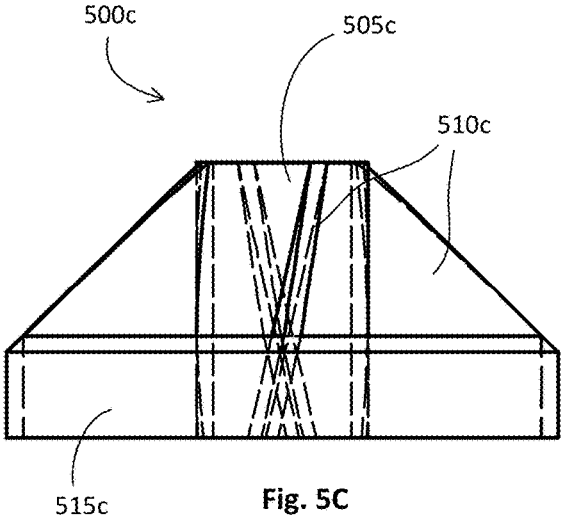
Figure 5D:
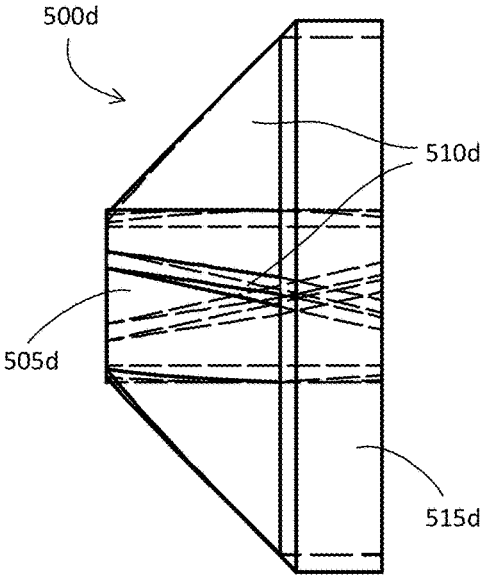
Figure 5B:
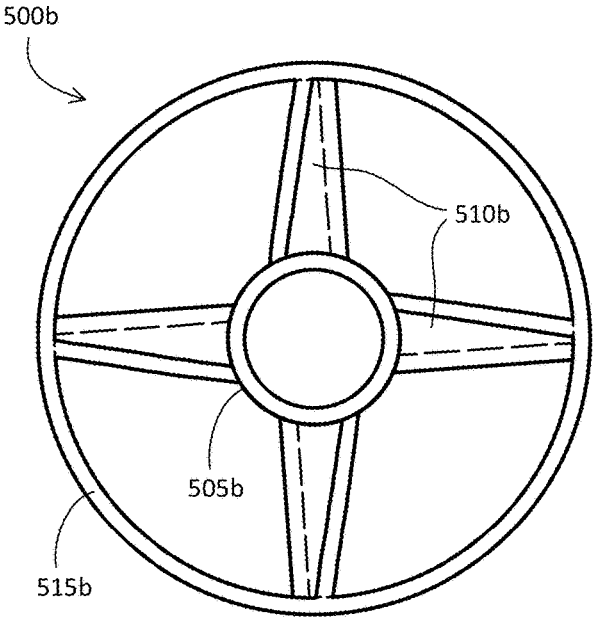
Figure 6A:
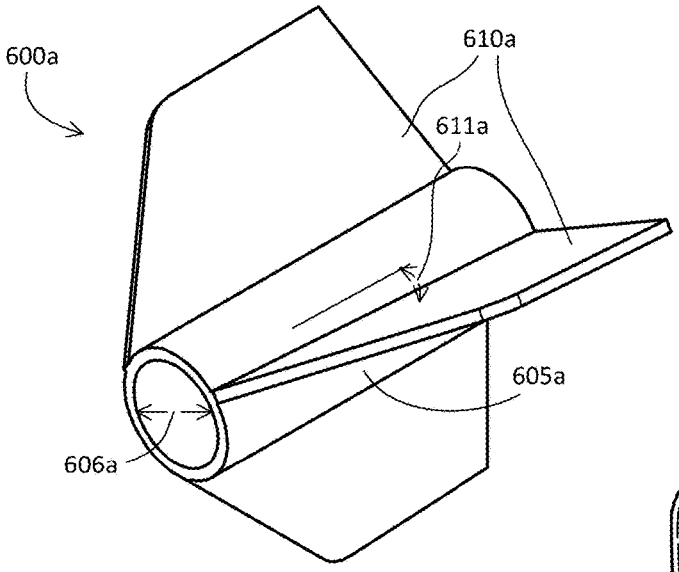
FIGS. 6A-D depict an example projectile stabilizer.
Figure 6C:
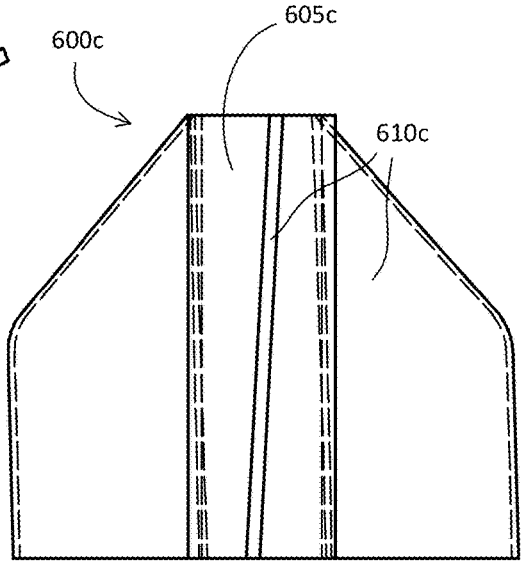
Figure 6D:
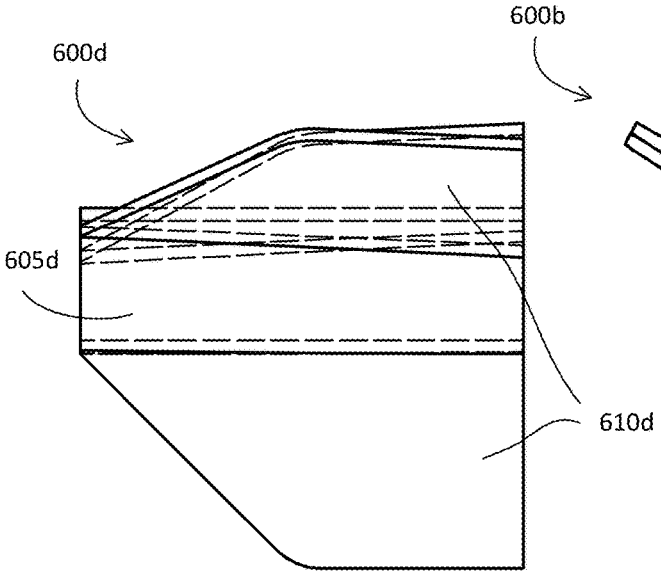
Figure 6B:
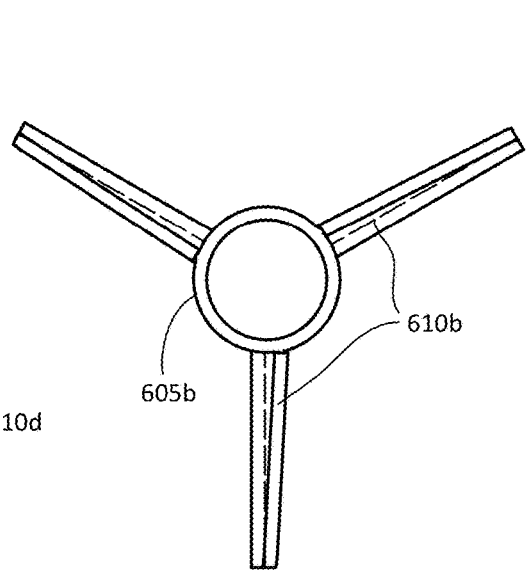
Figure 7A:
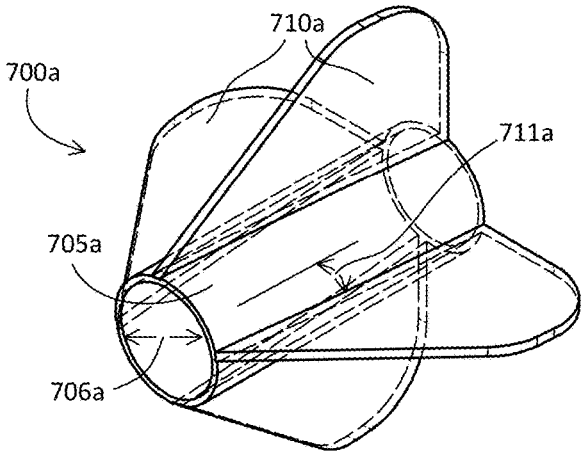
FIGS. 7A-D depict an example projectile stabilizer.
Figure 7C:
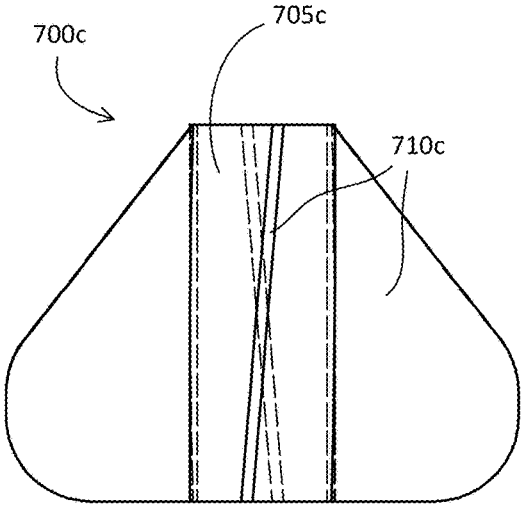
Figure 7D:
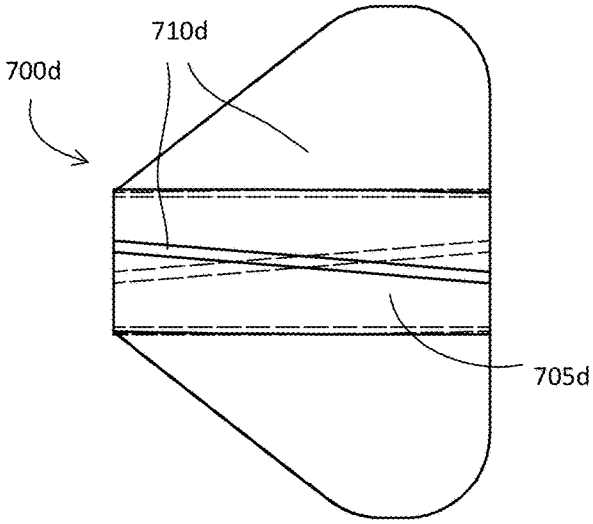
Figure 7B:
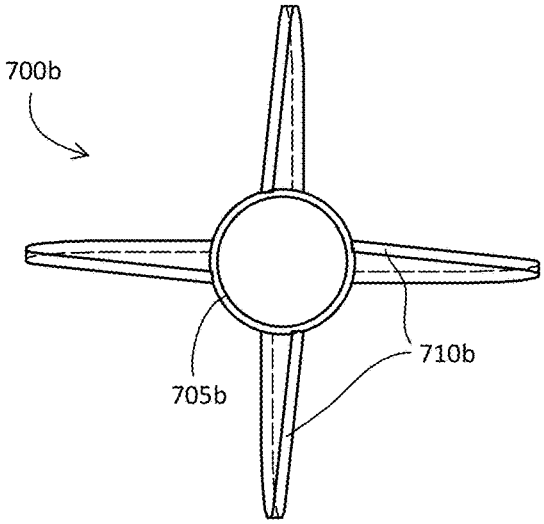
Figure 8A:
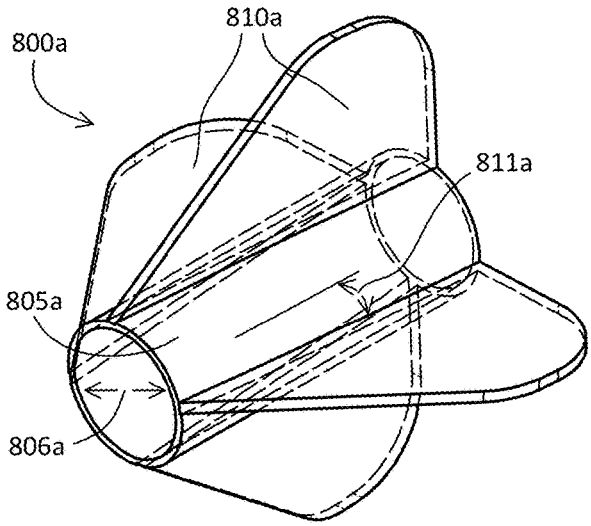
FIGS. 8A-D depict an example projectile stabilizer.
Figure 8C:
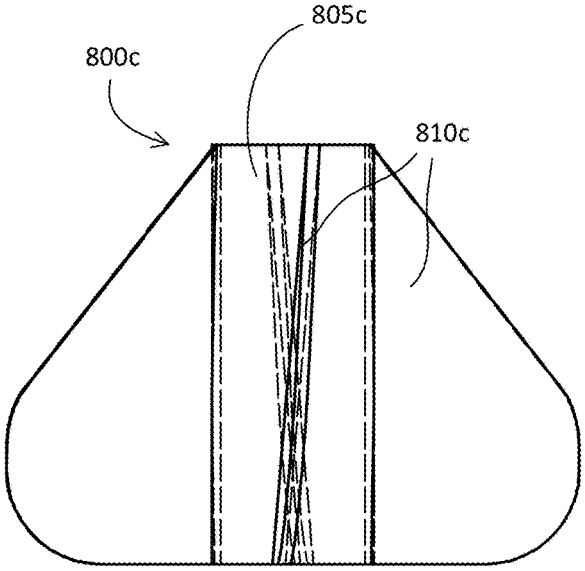
Figure 8D:
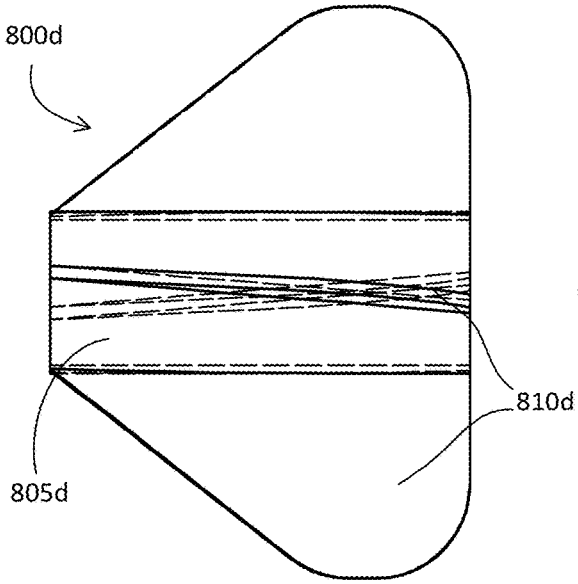
Figure 8B:
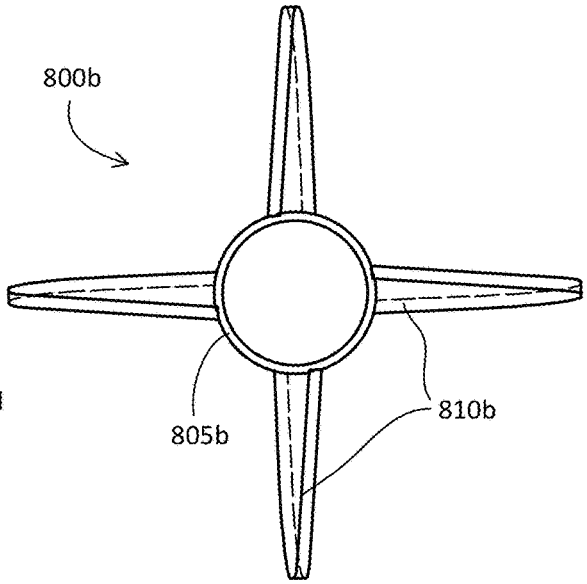
Figure 9A:
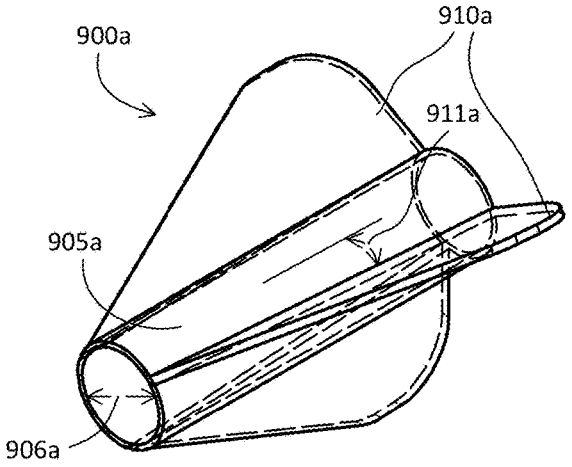
FIGS. 9A-D depict an example projectile stabilizer.
Figure 9C:
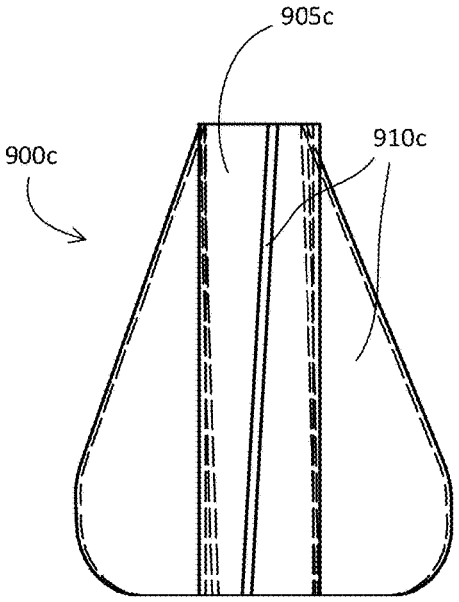
Figure 9D:
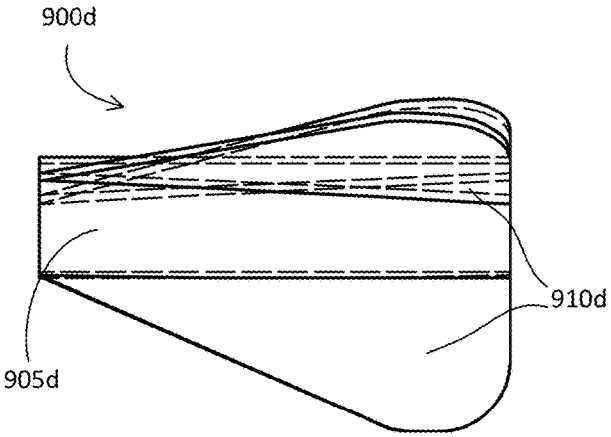
Figure 9B:
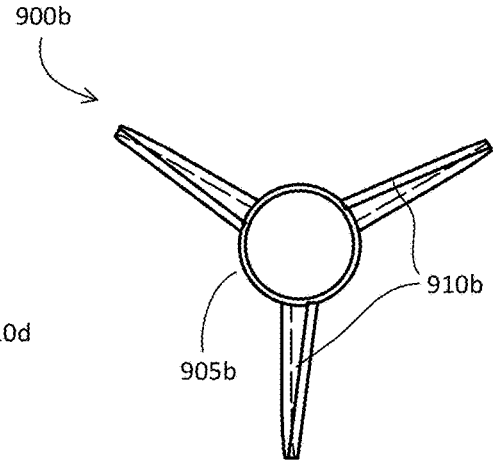
Figure 10A:
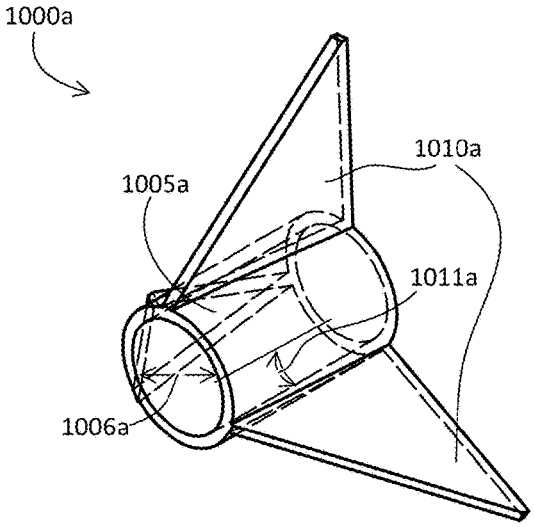
FIGS. 10A-D depict an example projectile stabilizer.
Figure 10C:
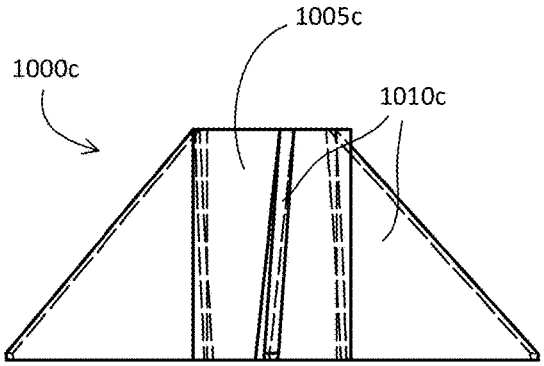
Figure 10D:
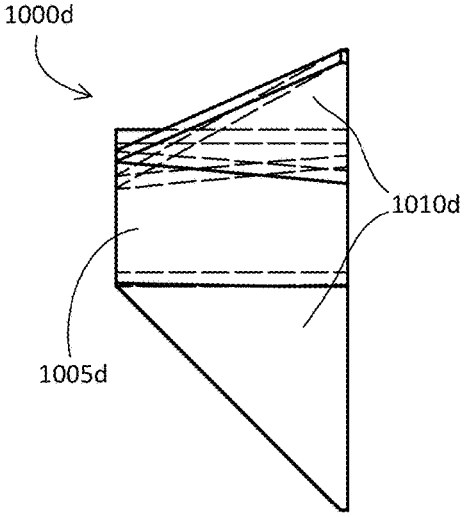
Figure 10B:
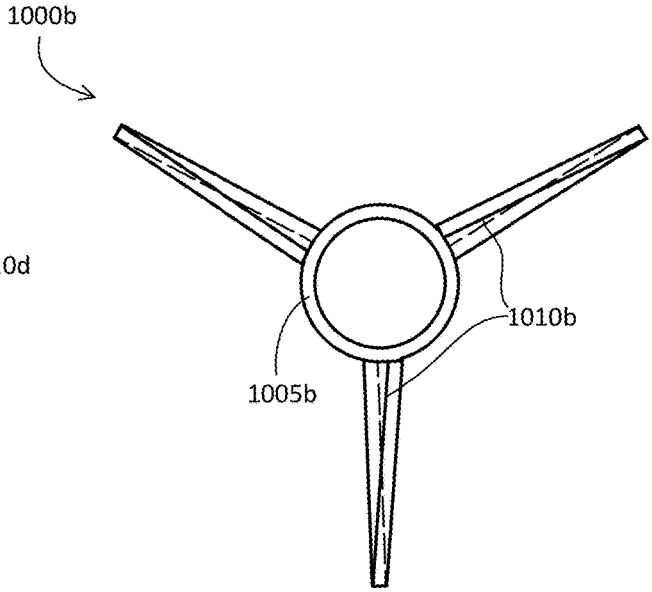
Figure 11A:
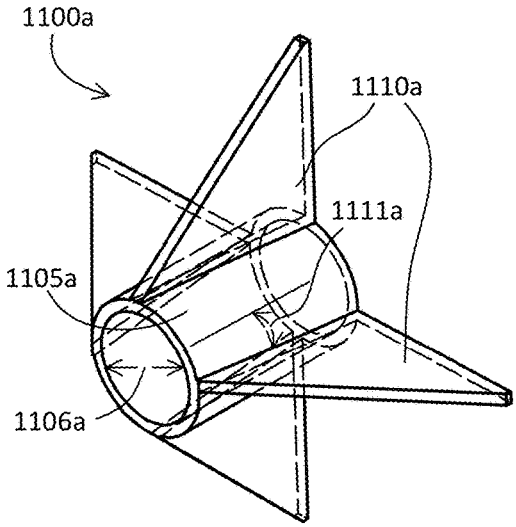
FIGS. 11A-D depict an example projectile stabilizer.
Figure 11C:
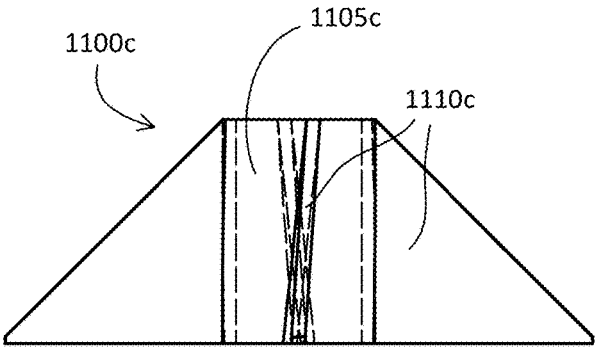
Figure 11D:
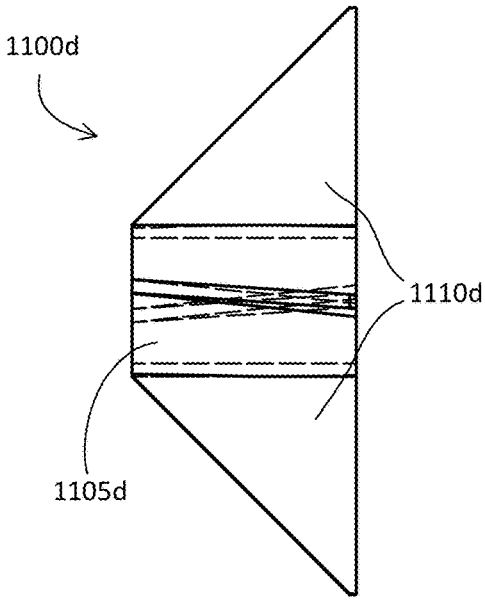
Figure 11B:
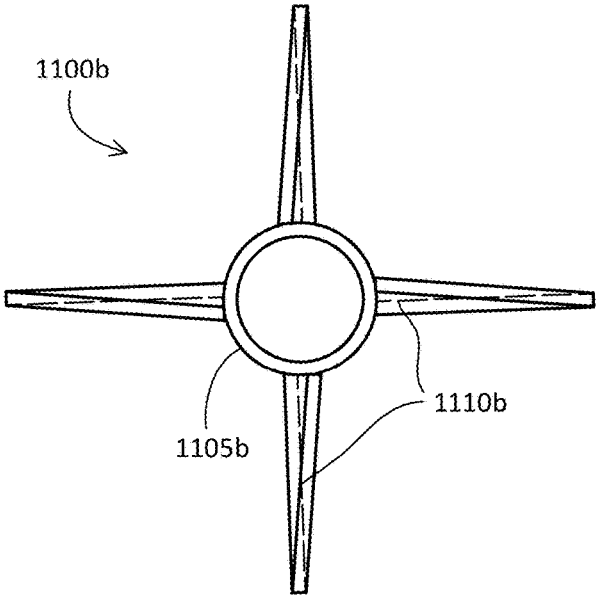
Figure 12A:
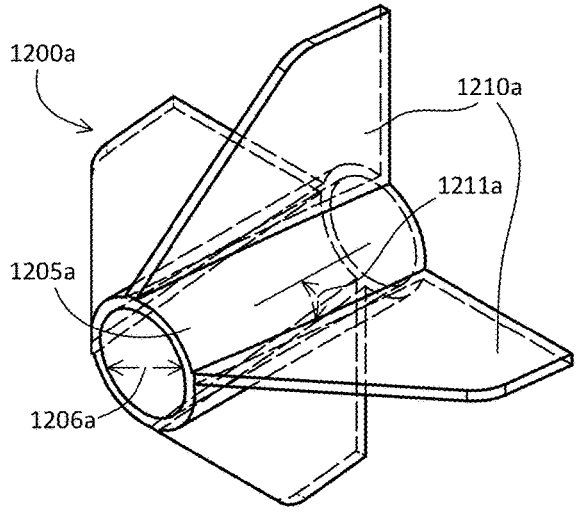
FIGS. 12A-D depict an example projectile stabilizer.
Figure 12C:
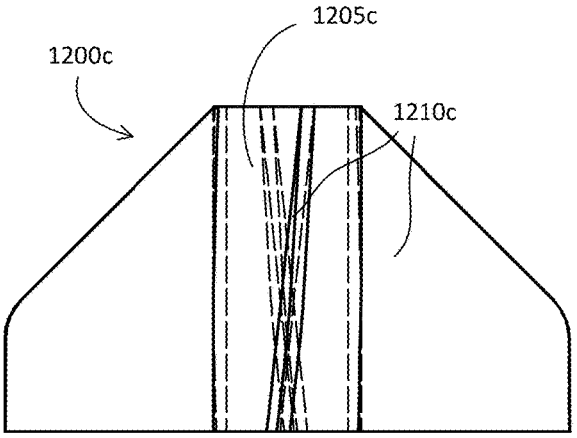
Figure 12D:
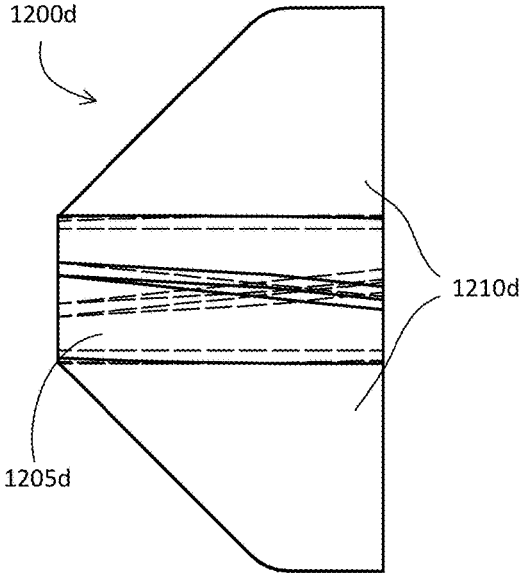
Figure 12B:
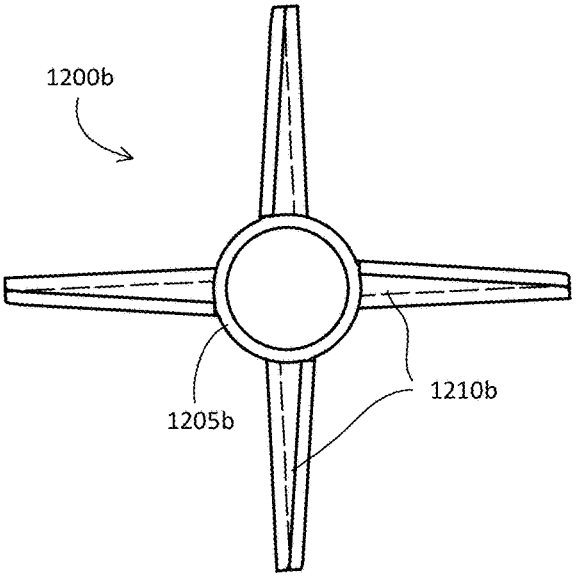
Figure 13A:
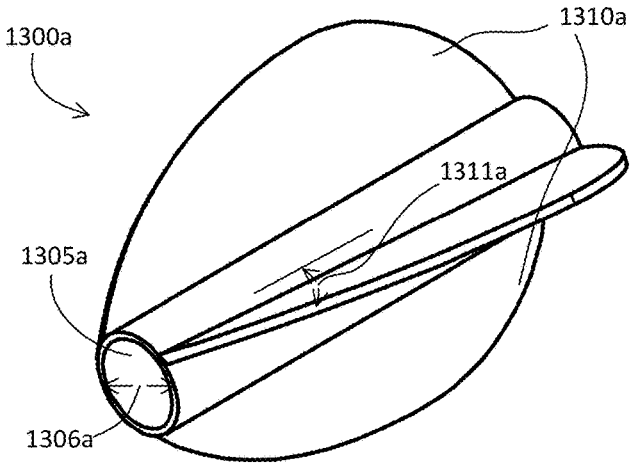
FIGS. 13A-D depict an example projectile stabilizer.
Figure 13C:
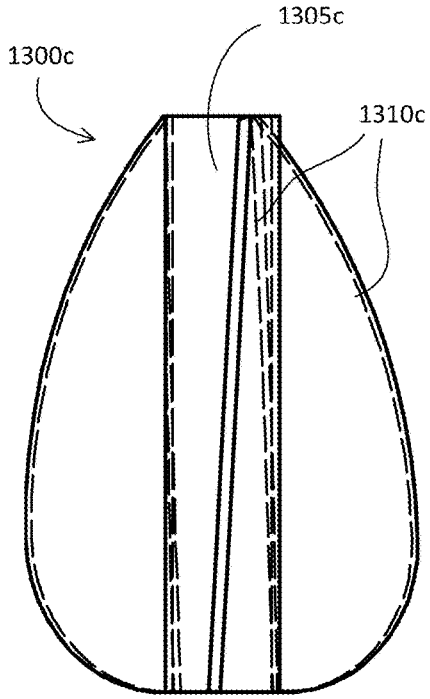
Figure 13D:
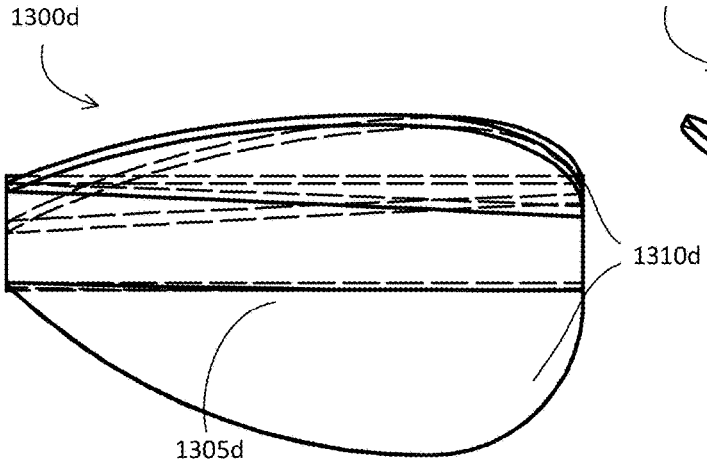
Figure 13B:
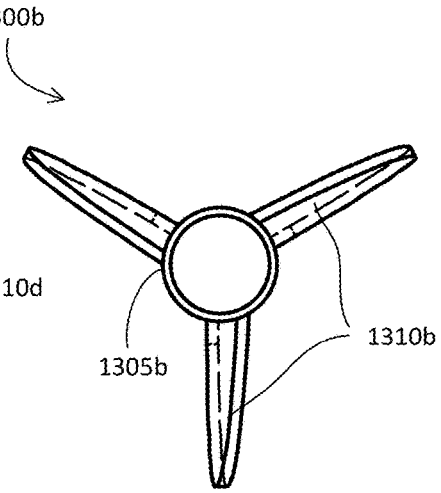
Figure 14A:
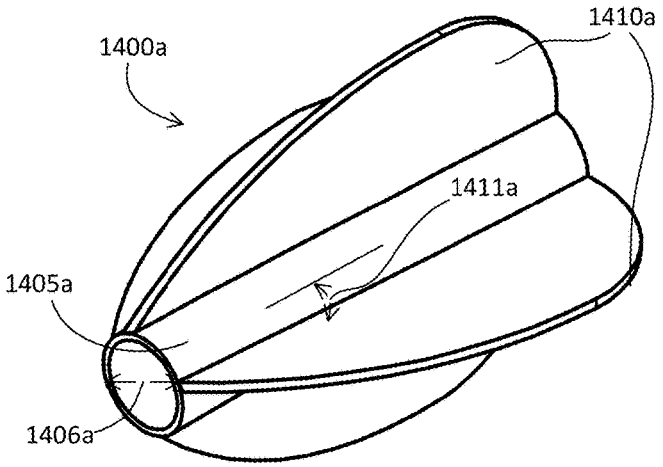
FIGS. 14A-D depict an example projectile stabilizer.
Figure 14C:
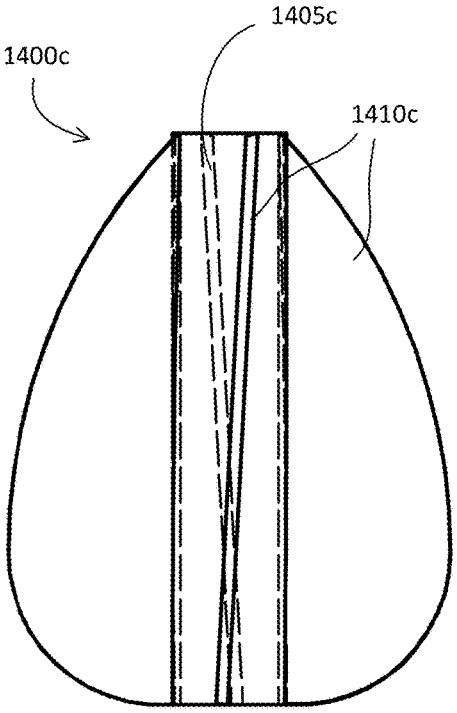
Figure 14D:
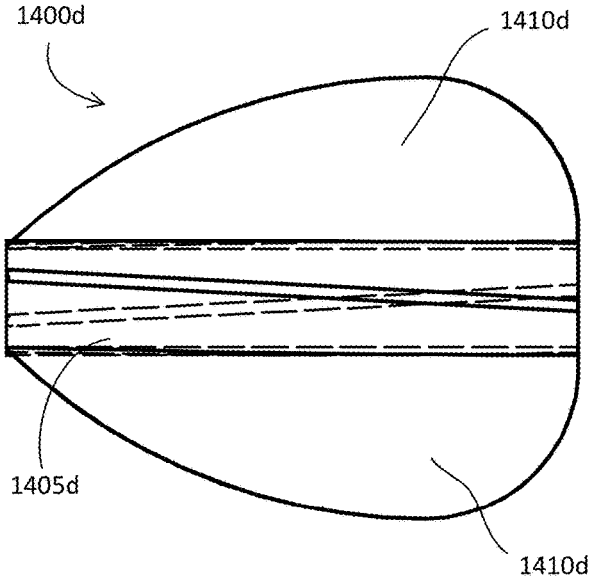
Figure 14B:
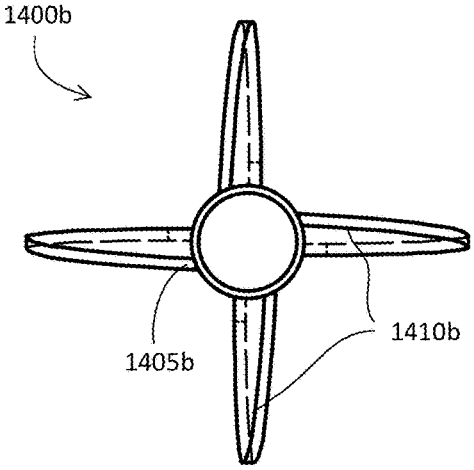
Figure 15A:
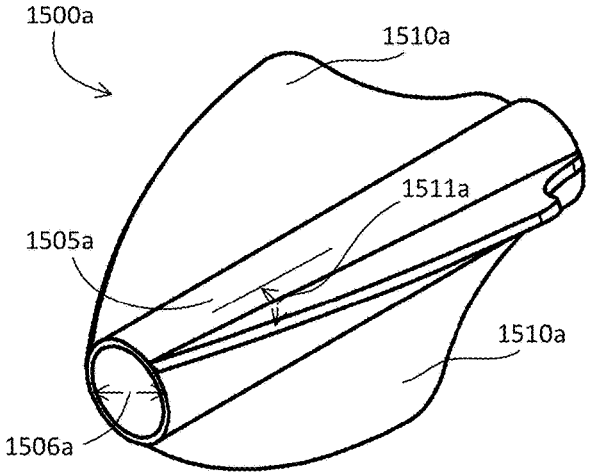
FIGS. 15A-D depict an example projectile stabilizer.
Figure 15C:
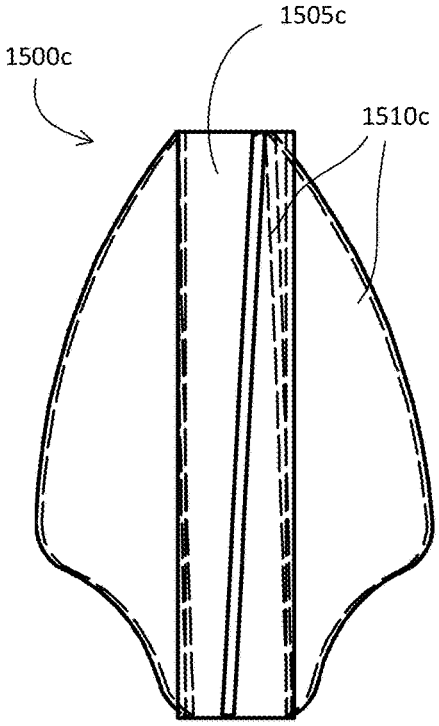
Figure 15D:
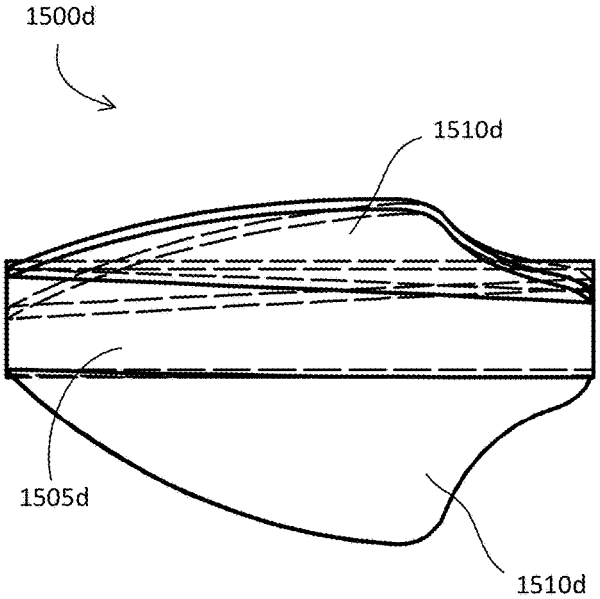
Figure 15B:
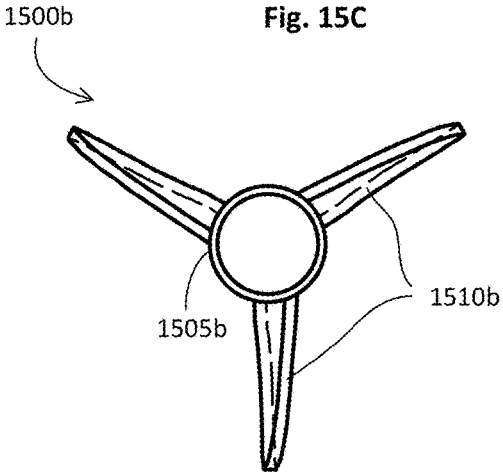
Figure 16A:
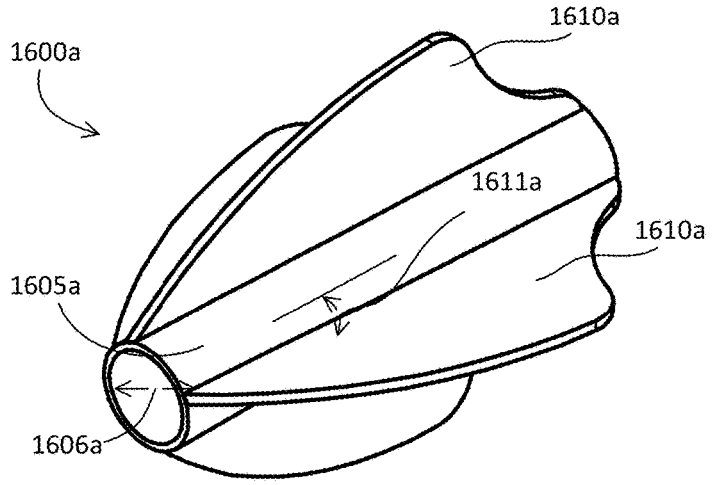
FIGS. 16A-D depict an example projectile stabilizer.
Figure 16C:
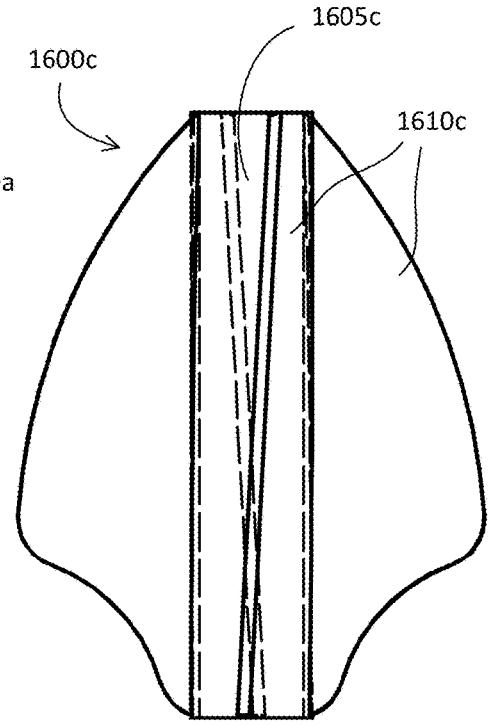
Figure 16D:
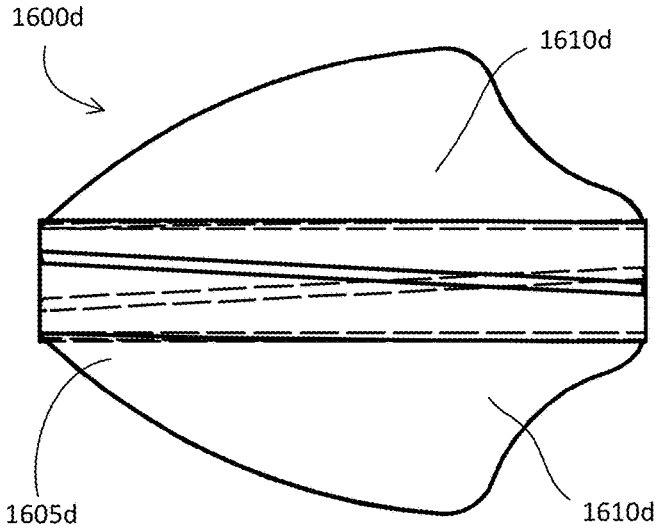
Figure 16B:
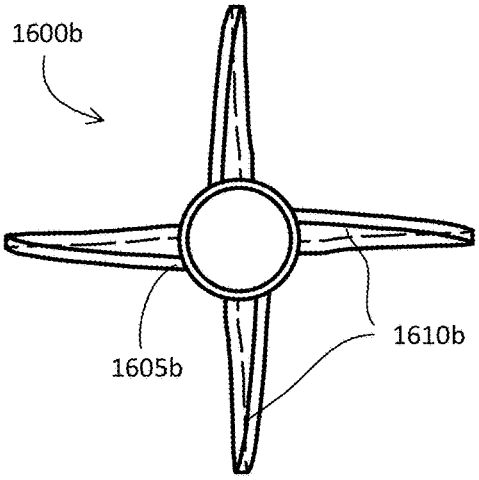

With reference to FIG. 2, a projectile 200 may be configured as, for example, a cross bow bolt 205. The cross bow bolt 205 may include a shaft 210 having an outside diameter 206, a stabilizer 215, a nock 220, and a tip 225. As described herein a stabilizer 215 may be configured as a "sliding" stabilizer, and may be field replaceable, may reduce assembly labor cost, and may significantly improve the stability of projectiles. The trailing end of the projectile 200 may comprise a recess (not shown) formed therein for engagement (e.g., via a plurality of threads) with a nock 220 that may secure the projectile 200 in place before launch (e.g., by disposing a bowstring (not shown) within a notched area of the nock 220.

Turning to FIGS. 3A-D, a stabilizer 300*a-d* may include a shaft receptacle 305*a-d* with an inside diameter 306*a*, and a plurality of fins 310*a-d*. The stabilizer 300*a-d* may be similar to either the stabilizer 115*a,b* of FIGS. 1A and 1B, respectively, or the stabilizer 215 of FIG. 2. The fins 310*a-d* may be oriented at an angle 311*a* with respect to a longitudinal axis of the shaft receptacle 305*a-d* in a straight line or forming an arc. Alternatively, the fins 310*a-d* may be oriented to extend parallel to a longitudinal axis of the shaft receptacle 305*a-d*. When the fins 310*a-d* are oriented at an angle 311*a* with respect to a longitudinal axis of the shaft receptacle 305*a-d*, the fins 310*a-d* may impart a rotational force on an associated projectile 100*a,b*/200 as the projectile 100*a,b*/200 is in flight.

While not shown in FIGS. 3A-D, the shaft receptacle 305*a-d* may include a central annular structure and a plurality of projections (or "fingers") formed within the shaft receptacle 305*a-d*. The fins 310*a-d* may have a dual function, serving both as aerodynamic elements and structural elements along with the shaft receptacle 305*a-d*. The stabilizer 300*a-d* may be designed to replace conventional fletching (i.e., to be used with a projectile having no other form of fletching). Although it is contemplated that, in certain embodiments, a stabilizer 300*a-d* may be used with a projectile having other fletching, such as fins. The shaft receptacle 305*a-d* may be formed within a central annular structure of the stabilizer 300*a-d*, and may be sized to have an inside diameter 306*a* that is less than an outside diameter 206 of a shaft 210 of a projectile 200 prior the shaft 210 being inserted within the shaft receptacle 305*a-d*. The shaft receptacle 305*a-d* (and potentially the entire stabilizer 300*a-d*) may be manufactured from an elastic material so that the shaft receptacle 305*a-d* may be stretched and a projectile shaft 210 can be slidably disposed within the shaft receptacle 305*a-d*. Subsequent to the shaft 210 being inserted within the stretched shaft receptacle 305*a-d*, an inside diameter 306*a* of the stretched shaft receptacle 305*a-d* may return toward an original dimension, thereby, securing the stabilizer 300*a-d* to the shaft 210. An inside diameter 306*a* relative to an outside diameter 206 and/or an elasticity of a shaft receptacle material may be selected based on how much force is desired to slide the stabilizer 300*a-d* relative to a longitudinal axis of the shaft 210.

Alternatively, the shaft receptacle 305*a-d* may have an inside diameter 306*a* that is larger than an outside diameter 206 of a shaft 210, and may include one or more projections (not shown in FIGS. 3A-D) formed within the shaft receptacle 305*a-d*, and may be adapted to secure the shaft 210 of a projectile 200 disposed within, such that the stabilizer 300*a-d* may be slidably captivated about the shaft without stretching the shaft receptacle (e.g., at the leading end of the projectile before it is launched).

With reference to FIGS. 4A-D, a stabilizer 400*a-d* may include a shaft receptacle 405*a-d* with an inside diameter 406*a*, a plurality of fins 410*a-d*, and a circumferentially extending wing 415*a-d*. The stabilizer 400*a-d* may be similar to either the stabilizer 115*a,b* of FIGS. 1A and 1B, respectively, or the stabilizer 215 of FIG. 2. The fins 410*a-d* may be oriented at an angle 411*a* with respect to a longitudinal axis of the shaft receptacle 405*a-d* in a straight line or forming an arc. Alternatively, the fins 410*a-d* may be oriented to extend parallel to a longitudinal axis of the shaft receptacle 405*a-d*. When the fins 410*a-d* are oriented at an angle 411*a* with respect to a longitudinal axis of the shaft receptacle 405*a-d*, the fins 410*a-d* may impart a rotational force on an associated projectile 100*a,b*/200 as the projectile 100*a,b*/200 is in flight.

While not shown in FIGS. 4A-D, the shaft receptacle 405*a-d* may include a central annular structure and a plurality of projections (or "fingers") formed within the shaft receptacle 405*a-d*. In addition to providing stability, the circumferentially extending wing 415*a-d* may be adapted to add rigidity to and/or to direct air to the fins 410*a-d*. The fins 410*a-d* may have a dual function, serving both as aerodynamic elements and structural elements bridging the circumferentially extending wing 415*a-d* and the shaft receptacle 405*a-d*. The stabilizer 400*a-d* may be designed to replace conventional fletching (i.e., to be used with a projectile having no other form of fletching). Although it is contemplated that, in certain embodiments, a stabilizer 400*a-d* may be used with a projectile having other fletching, such as fins. The shaft receptacle 405*a-d* may be formed within a central annular structure of the stabilizer 400*a-d*, and may be sized to have an inside diameter 406*a* that is less than an outside diameter 206 of a shaft 210 of a projectile 200 prior the shaft 210 being inserted within the shaft receptacle 405*a-d*. The shaft receptacle 405*a-d* (and potentially the entire stabilizer 400*a-d*) may be manufactured from an elastic material so that the shaft receptacle 405*a-d* may be stretched and a projectile shaft 210 can be slidably disposed within the shaft receptacle 405*a-d*. Subsequent to the shaft 210 being inserted within the stretched shaft receptacle 405*a-d*, an inside diameter 406*a* of the stretched shaft receptacle 405*a-d* may return toward an original dimension, thereby, securing the stabilizer 400*a-d* to the shaft 210. An inside diameter 406*a* relative to an outside diameter 206 and/or an elasticity of a shaft receptacle material may be selected based on how much force is desired to slide the stabilizer 400*a-d* relative to a longitudinal axis of the shaft 210.

Alternatively, the shaft receptacle 405*a-d* may have an inside diameter 406*a* that is larger than an outside diameter 206 of a shaft 210, and may include one or more projections (not shown in FIGS. 4A-D) formed within the shaft receptacle 405*a-d*, and may be adapted to secure the shaft 210 of a projectile 200 disposed within, such that the stabilizer 400*a-d* may be slidably captivated about the shaft without stretching the shaft receptacle (e.g., at the leading end of the projectile before it is launched).

Turning to FIGS. 5A-D, a stabilizer 500*a-d* may include a shaft receptacle 505*a-d* with an inside diameter 506*a*, a plurality of fins 510*a-d*, and a circumferentially extending wing 515*a-d*. The stabilizer 500*a-d* may be similar to either the stabilizer 115*a,b* of FIGS. 1A and 1B, respectively, or the stabilizer 215 of FIG. 2. The fins 510*a-d* may be oriented at an angle 511*a* with respect to a longitudinal axis of the shaft receptacle 505*a-d* in a straight line or forming an arc. Alternatively, the fins 510*a-d* may be oriented to extend parallel to a longitudinal axis of the shaft receptacle 505*a-d*. When the fins 510*a-d* are oriented at an angle 511*a* with respect to a longitudinal axis of the shaft receptacle 505*a-d*, the fins 510*a-d* may impart a rotational force on an associated projectile 100*a,b*/200 as the projectile 100*a,b*/200 is in flight.

While not shown in FIGS. 5A-D, the shaft receptacle 505*a-d* may include a central annular structure and a plurality of projections (or "fingers") formed within the shaft receptacle 505*a-d*. In addition to providing stability, the circumferentially extending wing 515*a-d* may be adapted to add rigidity to and/or to direct air to the fins 510*a-d*. The fins 510*a-d* may have a dual function, serving both as aerodynamic elements and structural elements bridging the circumferentially extending wing 515*a-d* and the shaft receptacle 505*a-d*. The stabilizer 500*a-d* may be designed to replace conventional fletching (i.e., to be used with a projectile having no other form of fletching). Although it is contemplated that, in certain embodiments, a stabilizer 500*a-d* may be used with a projectile having other fletching, such as fins. The shaft receptacle 505*a-d* may be formed within a central annular structure of the stabilizer 500*a-d*, and may be sized to have an inside diameter 506*a* that is less than an outside diameter 206 of a shaft 210 of a projectile 200 prior the shaft 210 being inserted within the shaft receptacle 505*a-d*. The shaft receptacle 505*a-d* (and potentially the entire stabilizer 500*a-d*) may be manufactured from an elastic material so that the shaft receptacle 505*a-d* may be stretched and a projectile shaft 210 can be slidably disposed within the shaft receptacle 505*a-d*. Subsequent to the shaft 210 being inserted within the stretched shaft receptacle 505*a-d*, an inside diameter 506*a* of the stretched shaft receptacle 505*a-d* may return toward an original dimension, thereby, securing the stabilizer 500*a-d* to the shaft 210. An inside diameter 506*a* relative to an outside diameter 206 and/or an elasticity of a shaft receptacle material may be selected based on how much force is desired to slide the stabilizer 500*a-d* relative to a longitudinal axis of the shaft 210.

Alternatively, the shaft receptacle 505*a-d* may have an inside diameter 506*a* that is larger than an outside diameter 206 of a shaft 210, and may include one or more projections (not shown in FIGS. 5A-D) formed within the shaft receptacle 505*a-d*, and may be adapted to secure the shaft 210 of a projectile 200 disposed within, such that the stabilizer 500*a-d* may be slidably captivated about the shaft without stretching the shaft receptacle (e.g., at the leading end of the projectile before it is launched).

With reference to FIGS. 6A-D, a stabilizer 600*a-d* may include a shaft receptacle 605*a-d* with an inside diameter 606*a*, and a plurality of fins 610*a-d*. The stabilizer 600*a-d* may be similar to either the stabilizer 115*a,b* of FIGS. 1A and 1B, respectively, or the stabilizer 215 of FIG. 2. The fins 610*a-d* may be oriented at an angle 611*a* with respect to a longitudinal axis of the shaft receptacle 605*a-d* in a straight line or forming an arc. Alternatively, the fins 610*a-d* may be oriented to extend parallel to a longitudinal axis of the shaft receptacle 605*a-d*. When the fins 610*a-d* are oriented at an angle 611*a* with respect to a longitudinal axis of the shaft receptacle 605*a-d*, the fins 610*a-d* may impart a rotational force on an associated projectile 100*a,b*/200 as the projectile 100*a,b*/200 is in flight.

While not shown in FIGS. 6A-D, the shaft receptacle 605*a-d* may include a central annular structure and a plurality of projections (or "fingers") formed within the shaft receptacle 605*a-d*. The fins 610*a-d* may have a dual function, serving both as aerodynamic elements and structural elements along with the shaft receptacle 605*a-d*. The stabilizer 600*a-d* may be designed to replace conventional fletching (i.e., to be used with a projectile having no other form of fletching). Although it is contemplated that, in certain embodiments, a stabilizer 600*a-d* may be used with a projectile having other fletching, such as fins. The shaft receptacle 605*a-d* may be formed within a central annular structure of the stabilizer 600*a-d*, and may be sized to have an inside diameter 606*a* that is less than an outside diameter 206 of a shaft 210 of a projectile 200 prior the shaft 210 being inserted within the shaft receptacle 605*a-d*. The shaft receptacle 605*a-d* (and potentially the entire stabilizer 600*a-d*) may be manufactured from an elastic material so that the shaft receptacle 605*a-d* may be stretched and a projectile shaft 210 can be slidably disposed within the shaft receptacle 605*a-d*. Subsequent to the shaft 210 being inserted within the stretched shaft receptacle 605*a-d*, an inside diameter 606*a* of the stretched shaft receptacle 605*a-d* may return toward an original dimension, thereby, securing the stabilizer 600*a-d* to the shaft 210. An inside diameter 606*a* relative to an outside diameter 206 and/or an elasticity of a shaft receptacle material may be selected based on how much force is desired to slide the stabilizer 600*a-d* relative to a longitudinal axis of the shaft 210.

Alternatively, the shaft receptacle 605*a-d* may have an inside diameter 606*a* that is larger than an outside diameter 206 of a shaft 210, and may include one or more projections (not shown in FIGS. 6A-D) formed within the shaft receptacle 605*a-d*, and may be adapted to secure the shaft 210 of a projectile 200 disposed within, such that the stabilizer 600*a-d* may be slidably captivated about the shaft without stretching the shaft receptacle (e.g., at the leading end of the projectile before it is launched).

Turning to FIGS. 7A-D, a stabilizer 700*a-d* may include a shaft receptacle 705*a-d* with an inside diameter 706*a*, and a plurality of fins 710*a-d*. The stabilizer 700*a-d* may be similar to either the stabilizer 115*a,b* of FIGS. 1A and 1B, respectively, or the stabilizer 215 of FIG. 2. The fins 710*a-d* may be oriented at an angle 711*a* with respect to a longitudinal axis of the shaft receptacle 705*a-d* in a straight line or forming an arc. Alternatively, the fins 710*a-d* may be oriented to extend parallel to a longitudinal axis of the shaft receptacle 705*a-d*. When the fins 710*a-d* are oriented at an angle 711*a* with respect to a longitudinal axis of the shaft receptacle 705*a-d*, the fins 710*a-d* may impart a rotational force on an associated projectile 100*a,b*/200 as the projectile 100*a,b*/200 is in flight.

While not shown in FIGS. 7A-D, the shaft receptacle 705*a-d* may include a central annular structure and a plurality of projections (or "fingers") formed within the shaft receptacle 705*a-d*. The fins 710*a-d* may have a dual function, serving both as aerodynamic elements and structural elements along with the shaft receptacle 705*a-d*. The stabilizer 700*a-d* may be designed to replace conventional fletching (i.e., to be used with a projectile having no other form of fletching). Although it is contemplated that, in certain embodiments, a stabilizer 700*a-d* may be used with a projectile having other fletching, such as fins. The shaft receptacle 705*a-d* may be formed within a central annular structure of the stabilizer 700*a-d*, and may be sized to have an inside diameter 706*a* that is less than an outside diameter 206 of a shaft 210 of a projectile 200 prior the shaft 210 being inserted within the shaft receptacle 705*a-d*. The shaft receptacle 705*a-d* (and potentially the entire stabilizer 700*a-d*) may be manufactured from an elastic material so that the shaft receptacle 705*a-d* may be stretched and a projectile shaft 210 can be slidably disposed within the shaft receptacle 705*a-d*. Subsequent to the shaft 210 being inserted within the stretched shaft receptacle 705*a-d*, an inside diameter 706*a* of the stretched shaft receptacle 705*a-d* may return toward an original dimension, thereby, securing the stabilizer 700*a-d* to the shaft 210. An inside diameter 706*a* relative to an outside diameter 206 and/or an elasticity of a shaft receptacle material may be selected based on how much force is desired to slide the stabilizer 700*a-d* relative to a longitudinal axis of the shaft 210.

Alternatively, the shaft receptacle 705*a-d* may have an inside diameter 706*a* that is larger than an outside diameter 206 of a shaft 210, and may include one or more projections (not shown in FIGS. 7A-D) formed within the shaft receptacle 705*a-d*, and may be adapted to secure the shaft 210 of a projectile 200 disposed within, such that the stabilizer 700*a-d* may be slidably captivated about the shaft without stretching the shaft receptacle (e.g., at the leading end of the projectile before it is launched).

With reference to FIGS. 8A-D, a stabilizer 800*a-d* may include a shaft receptacle 805*a-d* with an inside diameter 806*a*, and a plurality of fins 810*a-d*. The stabilizer 800*a-d* may be similar to either the stabilizer 115*a,b* of FIGS. 1A and 1B, respectively, or the stabilizer 215 of FIG. 2. The fins 810*a-d* may be oriented at an angle 811*a* with respect to a longitudinal axis of the shaft receptacle 805*a-d* in a straight line or forming an arc. Alternatively, the fins 810*a-d* may be oriented to extend parallel to a longitudinal axis of the shaft receptacle 805*a-d*. When the fins 810*a-d* are oriented at an angle 811*a* with respect to a longitudinal axis of the shaft receptacle 805*a-d*, the fins 810*a-d* may impart a rotational force on an associated projectile 100*a,b*/200 as the projectile 100*a,b*/200 is in flight.

While not shown in FIGS. 8A-D, the shaft receptacle 805*a-d* may include a central annular structure and a plurality of projections (or "fingers") formed within the shaft receptacle 805*a-d*. The fins 810*a-d* may have a dual function, serving both as aerodynamic elements and structural elements along with the shaft receptacle 805*a-d*. The stabilizer 800*a-d* may be designed to replace conventional fletching (i.e., to be used with a projectile having no other form of fletching). Although it is contemplated that, in certain embodiments, a stabilizer 800*a-d* may be used with a projectile having other fletching, such as fins. The shaft receptacle 805*a-d* may be formed within a central annular structure of the stabilizer 800*a-d*, and may be sized to have an inside diameter 806*a* that is less than an outside diameter 206 of a shaft 210 of a projectile 200 prior the shaft 210 being inserted within the shaft receptacle 805*a-d*. The shaft receptacle 805*a-d* (and potentially the entire stabilizer 800*a-d*) may be manufactured from an elastic material so that the shaft receptacle 805*a-d* may be stretched and a projectile shaft 210 can be slidably disposed within the shaft receptacle 805*a-d*. Subsequent to the shaft 210 being inserted within the stretched shaft receptacle 805*a-d*, an inside diameter 806*a* of the stretched shaft receptacle 805*a-d* may return toward an original dimension, thereby, securing the stabilizer 800*a-d* to the shaft 210. An inside diameter 806*a* relative to an outside diameter 206 and/or an elasticity of a shaft receptacle material may be selected based on how much force is desired to slide the stabilizer 800*a-d* relative to a longitudinal axis of the shaft 210.

Alternatively, the shaft receptacle 805*a-d* may have an inside diameter 806*a* that is larger than an outside diameter 206 of a shaft 210, and may include one or more projections (not shown in FIGS. 8A-D) formed within the shaft receptacle 805*a-d*, and may be adapted to secure the shaft 210 of a projectile 200 disposed within, such that the stabilizer 800*a-d* may be slidably captivated about the shaft without stretching the shaft receptacle (e.g., at the leading end of the projectile before it is launched).

Turning to FIGS. 9A-D, a stabilizer 900*a-d* may include a shaft receptacle 905*a-d* with an inside diameter 906*a*, and a plurality of fins 910*a-d*. The stabilizer 900*a-d* may be similar to either the stabilizer 115*a,b* of FIGS. 1A and 1B, respectively, or the stabilizer 215 of FIG. 2. The fins 910*a-d* may be oriented at an angle 911*a* with respect to a longitudinal axis of the shaft receptacle 905*a-d* in a straight line or forming an arc. Alternatively, the fins 910*a-d* may be oriented to extend parallel to a longitudinal axis of the shaft receptacle 905*a-d*. When the fins 910*a-d* are oriented at an angle 911*a* with respect to a longitudinal axis of the shaft receptacle 905*a-d*, the fins 910*a-d* may impart a rotational force on an associated projectile 100*a,b*/200 as the projectile 100*a,b*/200 is in flight.

While not shown in FIGS. 9A-D, the shaft receptacle 905*a-d* may include a central annular structure and a plurality of projections (or "fingers") formed within the shaft receptacle 905*a-d*. The fins 910*a-d* may have a dual function, serving both as aerodynamic elements and structural elements along with the shaft receptacle 905*a-d*. The stabilizer 900*a-d* may be designed to replace conventional fletching (i.e., to be used with a projectile having no other form of fletching). Although it is contemplated that, in certain embodiments, a stabilizer 900*a-d* may be used with a projectile having other fletching, such as fins. The shaft receptacle 905*a-d* may be formed within a central annular structure of the stabilizer 900*a-d*, and may be sized to have an inside diameter 906*a* that is less than an outside diameter 206 of a shaft 210 of a projectile 200 prior the shaft 210 being inserted within the shaft receptacle 905*a-d*. The shaft receptacle 905*a-d* (and potentially the entire stabilizer 900*a-d*) may be manufactured from an elastic material so that the shaft receptacle 905*a-d* may be stretched and a projectile shaft 210 can be slidably disposed within the shaft receptacle 905*a-d*. Subsequent to the shaft 210 being inserted within the stretched shaft receptacle 905*a-d*, an inside diameter 906*a* of the stretched shaft receptacle 905*a-d* may return toward an original dimension, thereby, securing the stabilizer 900*a-d* to the shaft 210. An inside diameter 906*a* relative to an outside diameter 206 and/or an elasticity of a shaft receptacle material may be selected based on how much force is desired to slide the stabilizer 900*a-d* relative to a longitudinal axis of the shaft 210.

Alternatively, the shaft receptacle 905*a-d* may have an inside diameter 906*a* that is larger than an outside diameter 206 of a shaft 210, and may include one or more projections (not shown in FIGS. 9A-D) formed within the shaft receptacle 905*a-d*, and may be adapted to secure the shaft 210 of a projectile 200 disposed within, such that the stabilizer 900*a-d* may be slidably captivated about the shaft without stretching the shaft receptacle (e.g., at the leading end of the projectile before it is launched).

With reference to FIGS. 10A-D, a stabilizer 1000*a-d* may include a shaft receptacle 1005*a-d* with an inside diameter 1006*a*, and a plurality of fins 0*a-d*. The stabilizer 1000*a-d* may be similar to either the stabilizer 115*a,b* of FIGS. 1A and 1B, respectively, or the stabilizer 215 of FIG. 2. The fins 0*a-d* may be oriented at an angle 1*a* with respect to a longitudinal axis of the shaft receptacle 1005*a-d* in a straight line or forming an arc. Alternatively, the fins 0*a-d* may be oriented to extend parallel to a longitudinal axis of the shaft receptacle 1005*a-d*. When the fins 0*a-d* are oriented at an angle 1*a* with respect to a longitudinal axis of the shaft receptacle 1005*a-d*, the fins 0*a-d* may impart a rotational force on an associated projectile 100*a,b*/200 as the projectile 100*a,b*/200 is in flight.

While not shown in FIGS. 10A-D, the shaft receptacle 1005*a-d* may include a central annular structure and a plurality of projections (or "fingers") formed within the shaft receptacle 1005*a-d*. The fins 0*a-d* may have a dual function, serving both as aerodynamic elements and structural elements along with the shaft receptacle 1005*a-d*. The stabilizer 1000*a-d* may be designed to replace conventional fletching (i.e., to be used with a projectile having no other form of fletching). Although it is contemplated that, in certain embodiments, a stabilizer 1000*a-d* may be used with a projectile having other fletching, such as fins. The shaft receptacle 1005*a-d* may be formed within a central annular structure of the stabilizer 1000*a-d*, and may be sized to have an inside diameter 1006*a* that is less than an outside diameter 206 of a shaft 210 of a projectile 200 prior the shaft 210 being inserted within the shaft receptacle 1005*a-d*. The shaft receptacle 1005*a-d* (and potentially the entire stabilizer 1000*a-d*) may be manufactured from an elastic material so that the shaft receptacle 1005*a-d* may be stretched and a projectile shaft 210 can be slidably disposed within the shaft receptacle 1005*a-d*. Subsequent to the shaft 210 being inserted within the stretched shaft receptacle 1005*a-d*, an inside diameter 1006*a* of the stretched shaft receptacle 1005*a-d* may return toward an original dimension, thereby, securing the stabilizer 1000*a-d* to the shaft 210. An inside diameter 1006*a* relative to an outside diameter 206 and/or an elasticity of a shaft receptacle material may be selected based on how much force is desired to slide the stabilizer 1000*a-d* relative to a longitudinal axis of the shaft 210.

Alternatively, the shaft receptacle 1005*a-d* may have an inside diameter 1006*a* that is larger than an outside diameter 206 of a shaft 210, and may include one or more projections (not shown in FIGS. 10A-D) formed within the shaft receptacle 1005*a-d*, and may be adapted to secure the shaft 210 of a projectile 200 disposed within, such that the stabilizer 1000*a-d* may be slidably captivated about the shaft without stretching the shaft receptacle (e.g., at the leading end of the projectile before it is launched).

Turning to FIGS. 11A-D, a stabilizer 1100*a-d* may include a shaft receptacle 1105*a-d* with an inside diameter 1106*a*, and a plurality of fins 1110*a-d*. The stabilizer 1100*a-d* may be similar to either the stabilizer 115*a,b* of FIGS. 1A and 1B, respectively, or the stabilizer 215 of FIG. 2. The fins 1110*a-d* may be oriented at an angle 1111*a* with respect to a longitudinal axis of the shaft receptacle 1105*a-d* in a straight line or forming an arc. Alternatively, the fins 1110*a-d* may be oriented to extend parallel to a longitudinal axis of the shaft receptacle 1105*a-d*. When the fins 1110*a-d* are oriented at an angle 1111*a* with respect to a longitudinal axis of the shaft receptacle 1105*a-d*, the fins 1110*a-d* may impart a rotational force on an associated projectile 100*a,b*/200 as the projectile 100*a,b*/200 is in flight.

While not shown in FIGS. 11A-D, the shaft receptacle 1105*a-d* may include a central annular structure and a plurality of projections (or "fingers") formed within the shaft receptacle 1105*a-d*. The fins 1110*a-d* may have a dual function, serving both as aerodynamic elements and structural elements along with the shaft receptacle 1105*a-d*. The stabilizer 1100*a-d* may be designed to replace conventional fletching (i.e., to be used with a projectile having no other form of fletching). Although it is contemplated that, in certain embodiments, a stabilizer 1100*a-d* may be used with a projectile having other fletching, such as fins. The shaft receptacle 1105*a-d* may be formed within a central annular structure of the stabilizer 1100*a-d*, and may be sized to have an inside diameter 1106*a* that is less than an outside diameter 206 of a shaft 210 of a projectile 200 prior the shaft 210 being inserted within the shaft receptacle 1105*a-d*. The shaft receptacle 1105*a-d* (and potentially the entire stabilizer 1100*a-d*) may be manufactured from an elastic material so that the shaft receptacle 1105*a-d* may be stretched and a projectile shaft 210 can be slidably disposed within the shaft receptacle 1105*a-d*. Subsequent to the shaft 210 being inserted within the stretched shaft receptacle 1105*a-d*, an inside diameter 1106*a* of the stretched shaft receptacle 1105*a-d* may return toward an original dimension, thereby, securing the stabilizer 1100*a-d* to the shaft 210. An inside diameter 1106*a* relative to an outside diameter 206 and/or an elasticity of a shaft receptacle material may be selected based on how much force is desired to slide the stabilizer 1100*a-d* relative to a longitudinal axis of the shaft 210.

Alternatively, the shaft receptacle 1105*a-d* may have an inside diameter 1106*a* that is larger than an outside diameter 206 of a shaft 210, and may include one or more projections (not shown in FIGS. 11A-D) formed within the shaft receptacle 1105*a-d*, and may be adapted to secure the shaft 210 of a projectile 200 disposed within, such that the stabilizer 1100*a-d* may be slidably captivated about the shaft without stretching the shaft receptacle (e.g., at the leading end of the projectile before it is launched).

With reference to FIGS. 12A-D, a stabilizer 1200*a-d* may include a shaft receptacle 1205*a-d* with an inside diameter 1206*a*, and a plurality of fins 1210*a-d*. The stabilizer 1200*a-d* may be similar to either the stabilizer 115*a,b* of FIGS. 1A and 1B, respectively, or the stabilizer 215 of FIG. 2. The fins 1210*a-d* may be oriented at an angle 1211*a* with respect to a longitudinal axis of the shaft receptacle 1205*a-d* in a straight line or forming an arc. Alternatively, the fins 1210*a-d* may be oriented to extend parallel to a longitudinal axis of the shaft receptacle 1205*a-d*. When the fins 1210*a-d* are oriented at an angle 1211*a* with respect to a longitudinal axis of the shaft receptacle 1205*a-d*, the fins 1210*a-d* may impart a rotational force on an associated projectile 100*a, b*/200 as the projectile 100*a,b*/200 is in flight.

While not shown in FIGS. 12A-D, the shaft receptacle 1205*a-d* may include a central annular structure and a plurality of projections (or "fingers") formed within the shaft receptacle 1205*a-d*. The fins 1210*a-d* may have a dual function, serving both as aerodynamic elements and structural elements along with the shaft receptacle 1205*a-d*. The stabilizer 1200*a-d* may be designed to replace conventional fletching (i.e., to be used with a projectile having no other form of fletching). Although it is contemplated that, in certain embodiments, a stabilizer 1200*a-d* may be used with a projectile having other fletching, such as fins. The shaft receptacle 1205*a-d* may be formed within a central annular structure of the stabilizer 1200*a-d*, and may be sized to have an inside diameter 1206*a* that is less than an outside diameter 206 of a shaft 210 of a projectile 200 prior the shaft 210 being inserted within the shaft receptacle 1205*a-d*. The shaft receptacle 1205*a-d* (and potentially the entire stabilizer 1200*a-d*) may be manufactured from an elastic material so that the shaft receptacle 1205*a-d* may be stretched and a projectile shaft 210 can be slidably disposed within the shaft receptacle 1205*a-d*. Subsequent to the shaft 210 being inserted within the stretched shaft receptacle 1205*a-d*, an inside diameter 1206*a* of the stretched shaft receptacle 1205*a-d* may return toward an original dimension, thereby, securing the stabilizer 1200*a-d* to the shaft 210. An inside diameter 1206*a* relative to an outside diameter 206 and/or an elasticity of a shaft receptacle material may be selected based on how much force is desired to slide the stabilizer 1200*a-d* relative to a longitudinal axis of the shaft 210.

Alternatively, the shaft receptacle 1205*a-d* may have an inside diameter 1206*a* that is larger than an outside diameter 206 of a shaft 210, and may include one or more projections (not shown in FIGS. 12A-D) formed within the shaft receptacle 1205*a-d*, and may be adapted to secure the shaft 210 of a projectile 200 disposed within, such that the stabilizer 1200*a-d* may be slidably captivated about the shaft without stretching the shaft receptacle (e.g., at the leading end of the projectile before it is launched).

Turning to FIGS. 13A-D, a stabilizer 1300*a-d* may include a shaft receptacle 1305*a-d* with an inside diameter 1306*a*, and a plurality of fins 1310*a-d*. The stabilizer 1300*a-d* may be similar to either the stabilizer 115*a,b* of FIGS. 1A and 1B, respectively, or the stabilizer 215 of FIG. 2. The fins 1310*a-d* may be oriented at an angle 1311*a* with respect to a longitudinal axis of the shaft receptacle 1305*a-d* in a straight line or forming an arc. Alternatively, the fins 1310*a-d* may be oriented to extend parallel to a longitudinal axis of the shaft receptacle 1305*a-d*. When the fins 1310*a-d* are oriented at an angle 1311*a* with respect to a longitudinal axis of the shaft receptacle 1305*a-d*, the fins 1310*a-d* may impart a rotational force on an associated projectile 100*a, b*/200 as the projectile 100*a,b*/200 is in flight.

While not shown in FIGS. 13A-D, the shaft receptacle 1305*a-d* may include a central annular structure and a plurality of projections (or "fingers") formed within the shaft receptacle 1305*a-d*. The fins 1310*a-d* may have a dual function, serving both as aerodynamic elements and structural elements along with the shaft receptacle 1305*a-d*. The stabilizer 1300*a-d* may be designed to replace conventional fletching (i.e., to be used with a projectile having no other form of fletching). Although it is contemplated that, in certain embodiments, a stabilizer 1300*a-d* may be used with a projectile having other fletching, such as fins. The shaft receptacle 1305*a-d* may be formed within a central annular structure of the stabilizer 1300*a-d*, and may be sized to have an inside diameter 1306*a* that is less than an outside diameter 206 of a shaft 210 of a projectile 200 prior the shaft 210 being inserted within the shaft receptacle 1305*a-d*. The shaft receptacle 1305*a-d* (and potentially the entire stabilizer 1300*a-d*) may be manufactured from an elastic material so that the shaft receptacle 1305*a-d* may be stretched and a projectile shaft 210 can be slidably disposed within the shaft receptacle 1305*a-d*. Subsequent to the shaft 210 being inserted within the stretched shaft receptacle 1305*a-d*, an inside diameter 1306*a* of the stretched shaft receptacle 1305*a-d* may return toward an original dimension, thereby, securing the stabilizer 1300*a-d* to the shaft 210. An inside diameter 1306*a* relative to an outside diameter 206 and/or an elasticity of a shaft receptacle material may be selected based on how much force is desired to slide the stabilizer 1300*a-d* relative to a longitudinal axis of the shaft 210.

Alternatively, the shaft receptacle 1305*a-d* may have an inside diameter 1306*a* that is larger than an outside diameter 206 of a shaft 210, and may include one or more projections (not shown in FIGS. 13A-D) formed within the shaft receptacle 1305*a-d*, and may be adapted to secure the shaft 210 of a projectile 200 disposed within, such that the stabilizer 1300*a-d* may be slidably captivated about the shaft without stretching the shaft receptacle (e.g., at the leading end of the projectile before it is launched).

With reference to FIGS. 14A-D, a stabilizer 1400*a-d* may include a shaft receptacle 1405*a-d* with an inside diameter 1406*a*, and a plurality of fins 1410*a-d*. The stabilizer

1400*a-d* may be similar to either the stabilizer 115*a,b* of FIGS. 1A and 1B, respectively, or the stabilizer 215 of FIG. 2. The fins 1410*a-d* may be oriented at an angle 1411*a* with respect to a longitudinal axis of the shaft receptacle 1405*a-d* in a straight line or forming an arc. Alternatively, the fins 1410*a-d* may be oriented to extend parallel to a longitudinal axis of the shaft receptacle 1405*a-d*. When the fins 1410*a-d* are oriented at an angle 1411*a* with respect to a longitudinal axis of the shaft receptacle 1405*a-d*, the fins 1410*a-d* may impart a rotational force on an associated projectile 100*a, b*/200 as the projectile 100*a,b*/200 is in flight.

While not shown in FIGS. 14A-D, the shaft receptacle 1405*a-d* may include a central annular structure and a plurality of projections (or "fingers") formed within the shaft receptacle 1405*a-d*. The fins 1410*a-d* may have a dual function, serving both as aerodynamic elements and structural elements along with the shaft receptacle 1405*a-d*. The stabilizer 1400*a-d* may be designed to replace conventional fletching (i.e., to be used with a projectile having no other form of fletching). Although it is contemplated that, in certain embodiments, a stabilizer 1400*a-d* may be used with a projectile having other fletching, such as fins. The shaft receptacle 1405*a-d* may be formed within a central annular structure of the stabilizer 1400*a-d*, and may be sized to have an inside diameter 1406*a* that is less than an outside diameter 206 of a shaft 210 of a projectile 200 prior the shaft 210 being inserted within the shaft receptacle 1405*a-d*. The shaft receptacle 1405*a-d* (and potentially the entire stabilizer 1400*a-d*) may be manufactured from an elastic material so that the shaft receptacle 1405*a-d* may be stretched and a projectile shaft 210 can be slidably disposed within the shaft receptacle 1405*a-d*. Subsequent to the shaft 210 being inserted within the stretched shaft receptacle 1405*a-d*, an inside diameter 1406*a* of the stretched shaft receptacle 1405*a-d* may return toward an original dimension, thereby, securing the stabilizer 1400*a-d* to the shaft 210. An inside diameter 1406*a* relative to an outside diameter 206 and/or an elasticity of a shaft receptacle material may be selected based on how much force is desired to slide the stabilizer 1400*a-d* relative to a longitudinal axis of the shaft 210.

Alternatively, the shaft receptacle 1405*a-d* may have an inside diameter 1406*a* that is larger than an outside diameter 206 of a shaft 210, and may include one or more projections (not shown in FIGS. 14A-D) formed within the shaft receptacle 1405*a-d*, and may be adapted to secure the shaft 210 of a projectile 200 disposed within, such that the stabilizer 1400*a-d* may be slidably captivated about the shaft without stretching the shaft receptacle (e.g., at the leading end of the projectile before it is launched).

Turning to FIGS. 15A-D, a stabilizer 1500*a-d* may include a shaft receptacle 1505*a-d* with an inside diameter 1506*a*, and a plurality of fins 1510*a-d*. The stabilizer 1500*a-d* may be similar to either the stabilizer 115*a,b* of FIGS. 1A and 1B, respectively, or the stabilizer 215 of FIG. 2. The fins 1510*a-d* may be oriented at an angle 1511*a* with respect to a longitudinal axis of the shaft receptacle 1505*a-d* in a straight line or forming an arc. Alternatively, the fins 1510*a-d* may be oriented to extend parallel to a longitudinal axis of the shaft receptacle 1505*a-d*. When the fins 1510*a-d* are oriented at an angle 1511*a* with respect to a longitudinal axis of the shaft receptacle 1505*a-d*, the fins 1510*a-d* may impart a rotational force on an associated projectile 100*a, b*/200 as the projectile 100*a,b*/200 is in flight.

While not shown in FIGS. 15A-D, the shaft receptacle 1505*a-d* may include a central annular structure and a plurality of projections (or "fingers") formed within the shaft receptacle 1505*a-d*. The fins 1510*a-d* may have a dual function, serving both as aerodynamic elements and structural elements along with the shaft receptacle 1505*a-d*. The stabilizer 1500*a-d* may be designed to replace conventional fletching (i.e., to be used with a projectile having no other form of fletching). Although it is contemplated that, in certain embodiments, a stabilizer 1500*a-d* may be used with a projectile having other fletching, such as fins. The shaft receptacle 1505*a-d* may be formed within a central annular structure of the stabilizer 1500*a-d*, and may be sized to have an inside diameter 1506*a* that is less than an outside diameter 206 of a shaft 210 of a projectile 200 prior the shaft 210 being inserted within the shaft receptacle 1505*a-d*. The shaft receptacle 1505*a-d* (and potentially the entire stabilizer 1500*a-d*) may be manufactured from an elastic material so that the shaft receptacle 1505*a-d* may be stretched and a projectile shaft 210 can be slidably disposed within the shaft receptacle 1505*a-d*. Subsequent to the shaft 210 being inserted within the stretched shaft receptacle 1505*a-d*, an inside diameter 1506*a* of the stretched shaft receptacle 1505*a-d* may return toward an original dimension, thereby, securing the stabilizer 1500*a-d* to the shaft 210. An inside diameter 1506*a* relative to an outside diameter 206 and/or an elasticity of a shaft receptacle material may be selected based on how much force is desired to slide the stabilizer 1500*a-d* relative to a longitudinal axis of the shaft 210.

Alternatively, the shaft receptacle 1505*a-d* may have an inside diameter 1506*a* that is larger than an outside diameter 206 of a shaft 210, and may include one or more projections (not shown in FIGS. 15A-D) formed within the shaft receptacle 1505*a-d*, and may be adapted to secure the shaft 210 of a projectile 200 disposed within, such that the stabilizer 1500*a-d* may be slidably captivated about the shaft without stretching the shaft receptacle (e.g., at the leading end of the projectile before it is launched).

With reference to FIGS. 16A-D, a stabilizer 1600*a-d* may include a shaft receptacle 1605*a-d* with an inside diameter 1606*a*, and a plurality of fins 1610*a-d*. The stabilizer 1600*a-d* may be similar to either the stabilizer 115*a,b* of FIGS. 1A and 1B, respectively, or the stabilizer 215 of FIG. 2. The fins 1610*a-d* may be oriented at an angle 1611*a* with respect to a longitudinal axis of the shaft receptacle 1605*a-d* in a straight line or forming an arc. Alternatively, the fins 1610*a-d* may be oriented to extend parallel to a longitudinal axis of the shaft receptacle 1605*a-d*. When the fins 1610*a-d* are oriented at an angle 1611*a* with respect to a longitudinal axis of the shaft receptacle 1605*a-d*, the fins 1610*a-d* may impart a rotational force on an associated projectile 100*a, b*/200 as the projectile 100*a,b*/200 is in flight.

While not shown in FIGS. 16A-D, the shaft receptacle 1605*a-d* may include a central annular structure and a plurality of projections (or "fingers") formed within the shaft receptacle 1605*a-d*. The fins 1610*a-d* may have a dual function, serving both as aerodynamic elements and structural elements along with the shaft receptacle 1605*a-d*. The stabilizer 1600*a-d* may be designed to replace conventional fletching (i.e., to be used with a projectile having no other form of fletching). Although it is contemplated that, in certain embodiments, a stabilizer 1600*a-d* may be used with a projectile having other fletching, such as fins. The shaft receptacle 1605*a-d* may be formed within a central annular structure of the stabilizer 1600*a-d*, and may be sized to have an inside diameter 1606*a* that is less than an outside diameter 206 of a shaft 210 of a projectile 200 prior the shaft 210 being inserted within the shaft receptacle 1605*a-d*. The shaft receptacle 1605*a-d* (and potentially the entire stabilizer 1600*a-d*) may be manufactured from an elastic material so that the shaft receptacle 1605*a-d* may be stretched and a projectile shaft 210 can be slidably disposed within the shaft receptacle 1605*a-d*. Subsequent to the shaft 210 being inserted within the stretched shaft receptacle 1605*a-d*, an inside diameter 1606*a* of the stretched shaft receptacle 1605*a-d* may return toward an original dimension, thereby, securing the stabilizer 1600*a-d* to the shaft 210. An inside diameter 1606*a* relative to an outside diameter 206 and/or an elasticity of a shaft receptacle material may be selected based on how much force is desired to slide the stabilizer 1600*a-d* relative to a longitudinal axis of the shaft 210.

Alternatively, the shaft receptacle 1605*a-d* may have an inside diameter 1606*a* that is larger than an outside diameter 206 of a shaft 210, and may include one or more projections (not shown in FIGS. 16A-D) formed within the shaft receptacle 1605*a-d*, and may be adapted to secure the shaft 210 of a projectile 200 disposed within, such that the stabilizer 1600*a-d* may be slidably captivated about the shaft without stretching the shaft receptacle (e.g., at the leading end of the projectile before it is launched).

Any one of the stabilizers described herein may include a plurality of fins oriented with respect to an associated central axis such that the stabilizer encourages projectile rotation about the central axis when the projectile is projected. Any given fin may be, for example, as illustrated in the accompanying figures. Any given fin may have a height extending radially from a projectile shaft receptacle. The height of any given fin may vary with respect a length. Any given fin may extend at an angle with respect to a central axis of the projectile shaft receptacle. The angle of any given fin may vary with respect a length (e.g., may define a linear line, may define a sweeping curve, may define a parabola, etc.).

In any event, a breakaway coefficient of friction, between an inner surface of a projectile shaft receptacle and an outer surface of a projectile shaft, may be above a value such that, for example, a surface area of the inner surface of the projectile shaft receptacle in combination with a pressure between the inner surface of the projectile shaft receptacle and the outer surface of the projectile shaft, and the value of the breakaway coefficient of friction between the inner surface of the projectile shaft receptacle and the outer surface of the projectile shaft, causes the projectile shaft to rotate about a central axis (e.g., right-hand rotation with respect to a projectile launch location, or left-hand rotation with respect to a projectile launch location) when the projectile is projected (i.e., the breakaway coefficient of friction, the surface area, and the pressure result in a rotational force above a rotational movement threshold). In other words, a rotational force exerted by a stabilizer on an associated projectile may be a function of a surface area of an inner surface of the projectile shaft receptacle in combination with a value of a breakaway coefficient of friction, and a pressure, between the inner surface of the projectile shaft receptacle and the outer surface of the associated projectile shaft. The pressure between the inner surface of the projectile shaft receptacle and the outer surface of the associated projectile shaft may be, for example, inversely proportional to an elasticity of a stabilizer material. Additionally, a coefficient of friction and/or an elasticity of a stabilizer material and/or a projectile shaft material may be, for example, a function of temperature.

In combination with above, the breakaway coefficient of friction, the surface area, and the pressure, between the inner surface of the projectile shaft receptacle and the outer surface of the associated projectile shaft may be below a linear movement threshold. The linear movement threshold may be representative of, for example, a breakaway force associated with a peak rotational force that a given stabilizer may exert on an associated projectile during flight of the projectile.

In any event, a stabilizer buyer/user may purchase a desired stabilizer via, for example, an ecommerce website wherein the buyer simply enters an outside diameter of an associated projectile, via a user interface, and the user interface may present a list of available/recommended stabilizers. Alternatively, or additionally, an initial user interface may include a list of projectile manufactures, etc., and a user selects an associated projectile from the list. The user interface then presents at least one stabilizer, or a list of available stabilizers, along with associated stabilizer specifications and/or prices.

Figure 17A:
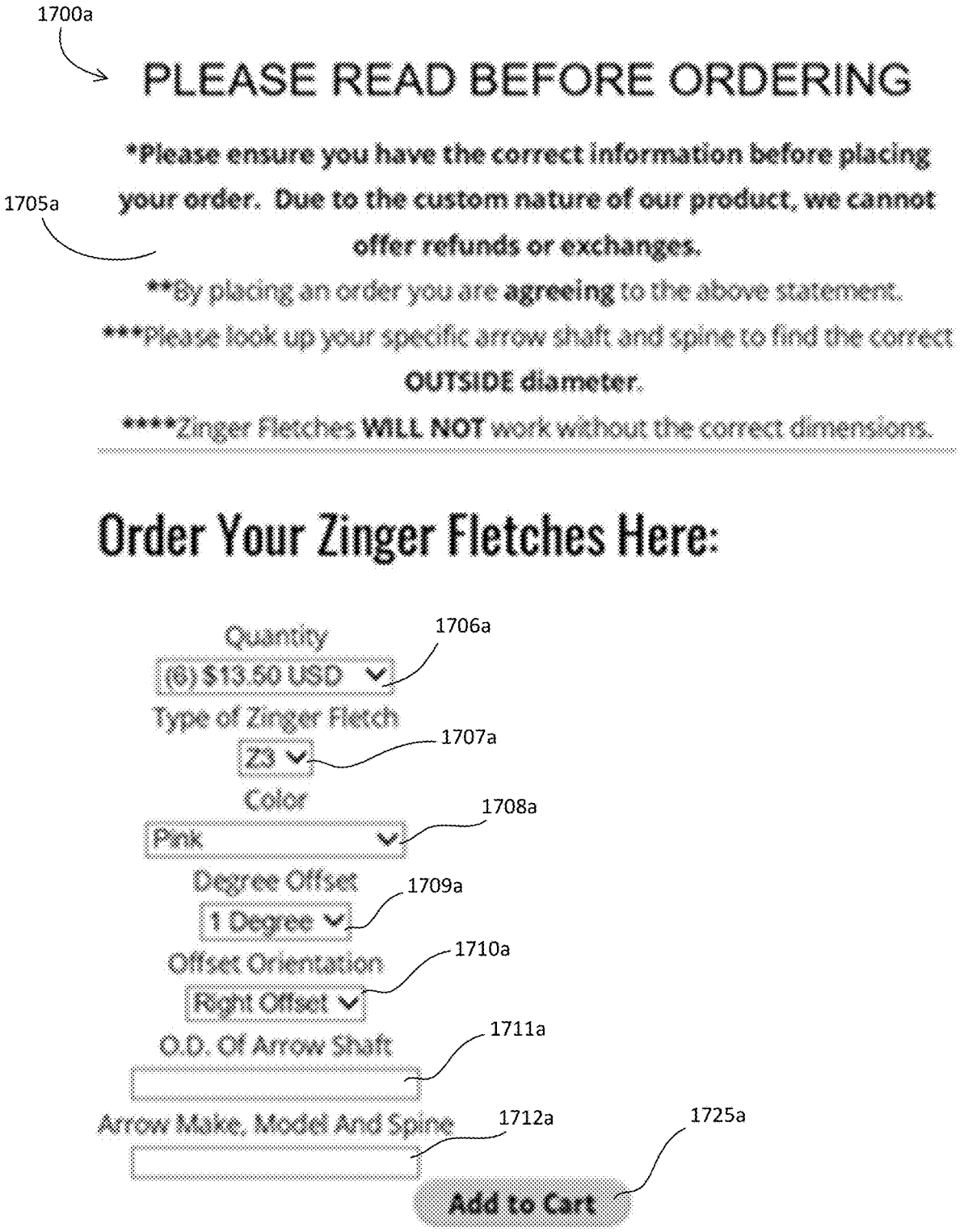

Turning to FIGS. 17A-D, user interfaces 1700*a-d* associated with stabilizer related ecommerce. As illustrated in FIG. 17A, a stabilizer purchase user interface 1700*a* may include stabilizer purchase information 1705*a*, a stabilizer quantity block 1706*a*, a type of stabilizer block 1707*a*, a stabilizer color block 1708*a*, a stabilizer degree of offset block 1709*a*, a stabilizer offset orientation block 1710*a*, a projectile shaft outside diameter block 1711*a*, a projectile identification block 1712*a*, and an add stabilizer purchase to cart selection icon 1725*a*

As also illustrated in FIG. 17B, a stabilizer information user interface 1700*b* may include general stabilizer information 1713*b*, stabilizer degree of offset information 1714*b*, stabilizer offset handedness information 1715*b*, and stabilizer left offset information 1716*b*. As further illustrated in FIG. 17C, a stabilizer test pack purchase user interface 1700*c* may include stabilizer test pack information 1717*c*, a test pack quantity block 1718*c*, a stabilizer color block 1719*c*, a stabilizer offset orientation block 1720*c*, a stabilizer shaft outside diameter block 1721*c*, a projectile identification block 1722*c*, and an add stabilizer test pack purchase to cart selection icon 1725*c*.

As yet further illustrated in FIG. 17D, a glow strip (or wrap) purchase user interface 1700*d* may include glow strip information 1723*d* and an add glow strip purchase to cart selection icon 1725*d*. Notably, a glow strip (or wrap) may be located between an associate projectile shaft and stabilizer (i.e., resulting in a different projectile shaft "effective" outside diameter and/or a different "effective" breakaway coefficient of friction. Alternatively, a glow strip (or wrap) may be placed elsewhere on an associated projectile/stabilizer.

Turning to FIGS. 18A-E, a system for generating stabilizers 1800*a* may include a customer device 1805*a,b* in communication with a remote device (e.g., a server) 1895*a,d* via a network 1870*a*. The system 1800*a* may implement communications between the customer device 1805*a,b* and the remote device 1895*a,d* (e.g., a remote server) to provide, for example, projectile information and/or stabilizer information to a projectile and fletch related database 1893*a*.

For example, the system 1800*a* may acquire projectile and/or stabilizer data from, for example, a user of a customer device 1805*a,b* (e.g., a desktop computer, a laptop computer, a personal digital assistant, a smart phone, a digital camera, smart watch, smart glasses, wearable electronics, laptop, etc.). Alternatively, or additionally, while not shown in FIGS. 18A-E, projectile and/or stabilizer data may be automatically obtained from a third party data source (e.g., a projectile manufacture, a wrap manufacturer, a three dimensional printer manufacturer, a three dimensional printer product material, a weather (temperature, wind, etc.), etc.).

As described in detail herein, the system 1800*a* may automatically generate at least one stabilizer (e.g., a 3D printed stabilizer, an injection molded stabilizer, etc.), stabilizer related information (e.g., printed, electronic, etc.), projectile related information (e.g., printed, electronic, etc.), and a related shipping label based upon, for example, projectile information and/or stabilizer information, etc.

Figure 18A:
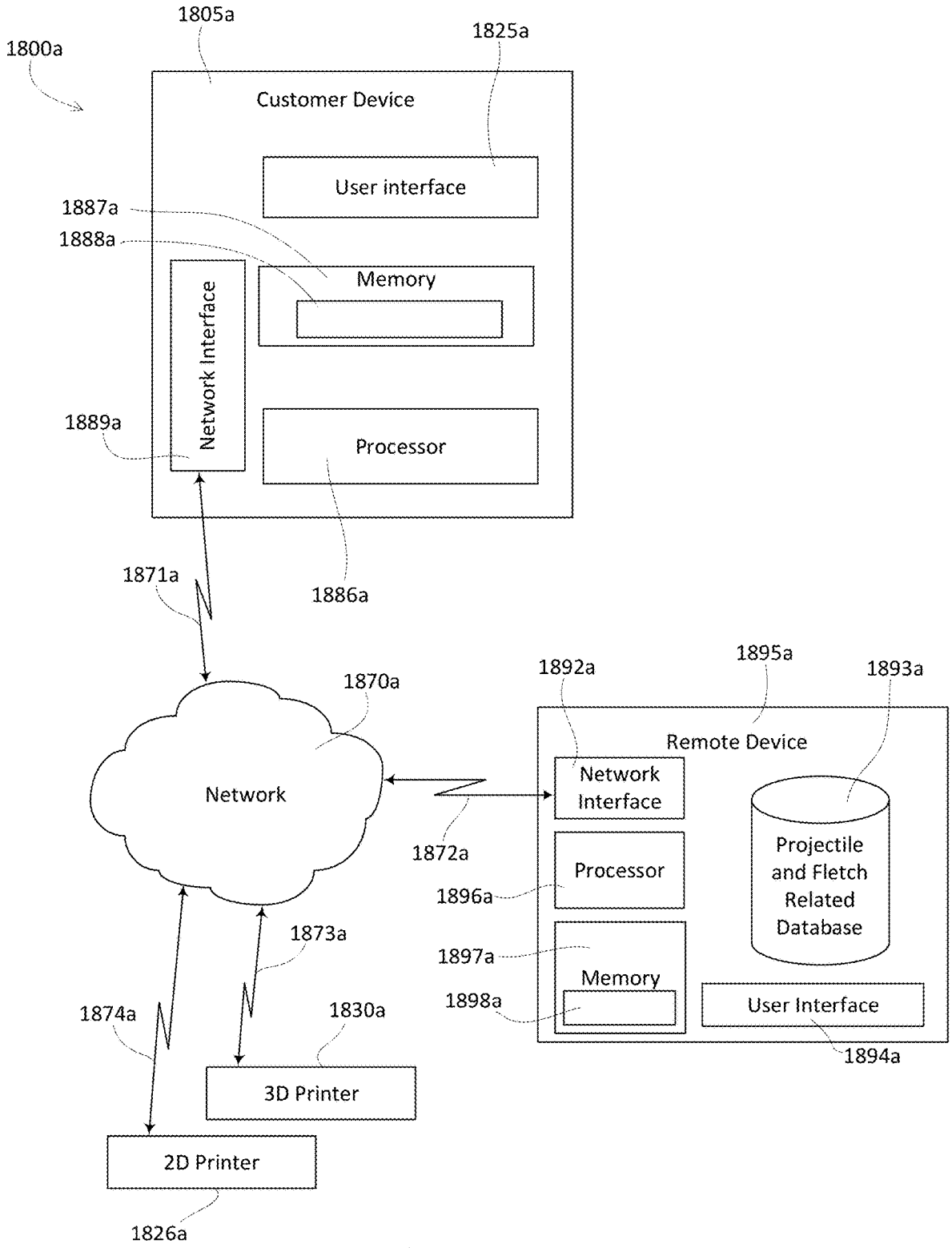
FIGS. 18A-E depict an example system for generating stabilizers and stabilizer related information.

For clarity, only one customer device 1805*a* is depicted in FIG. 18A. While FIG. 18A depicts only one customer device 1805*a,b*, it should be understood that any number of customer devices 1805*a,b* may be supported and that each customer device 1805*a,b* may be any appropriate computing or mobile device, such as a desktop computer, a mobile telephone, a smartphone, a personal data assistant (PDA), a tablet, a phablet, a pager, a smart watch, a smart bracelet, wearable electronics, and/or a lap-top computer. A customer device 1805*a,b* may include a memory 1887*a* and a processor 1886*a* for storing and executing, respectively, a module 1888*a*. The module 1888*a*, stored in the memory 1887*a* as a set of computer-readable instructions, may be related to an application for generating at least one stabilizer based upon projectile and/or stabilizer data that, when executed on the processor 1886*a*.

As described in detail herein, the module 1888*a* may facilitate interaction between an associated customer device 1805*a,b* and a remote device 1895*a,d*. For example, the processor 1886*a*, further executing the module 1888*a*, may facilitate communications between a remote device 1895*a,d* and a customer device 1805*a,b* via a customer device network interface 1889*a*, a customer device communication link 1871*a*, a network 1870*a*, a remote device communication link 1872*a*, and a remote device network interface 1892*a*.

A customer device 1805*a,b* may include a user interface 1825*a* which may be any type of electronic display device, such as touch screen display, a liquid crystal display (LCD), a light emitting diode (LED) display, a plasma display, a cathode ray tube (CRT) display, or any other type of known or suitable electronic display along with a user input device. A user interface 1825*a* may exhibit a user interface (e.g., any user interface 1700*a-d*) which depicts a user interface for configuring a client device 1805*a,b* to communicate with a remote device 1895*a,d*.

Figure 18B:
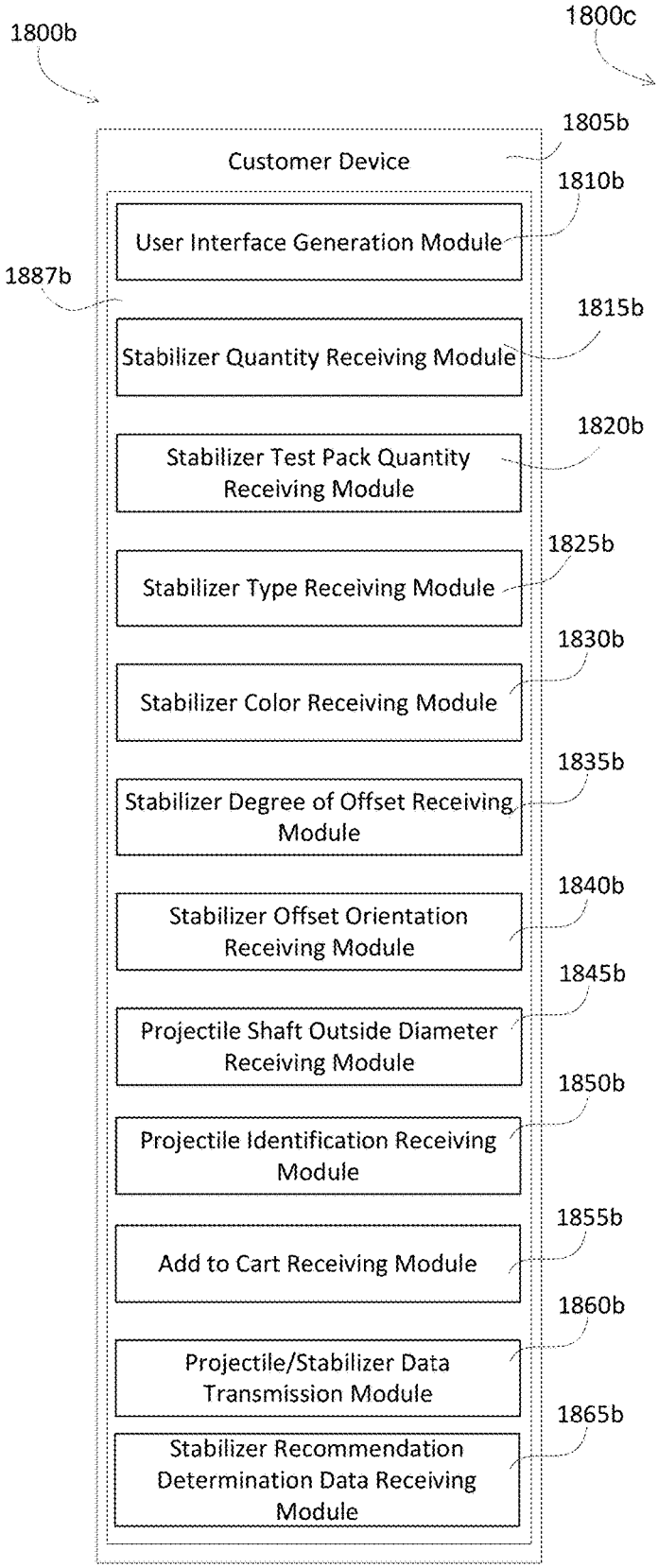
Figure 18C:
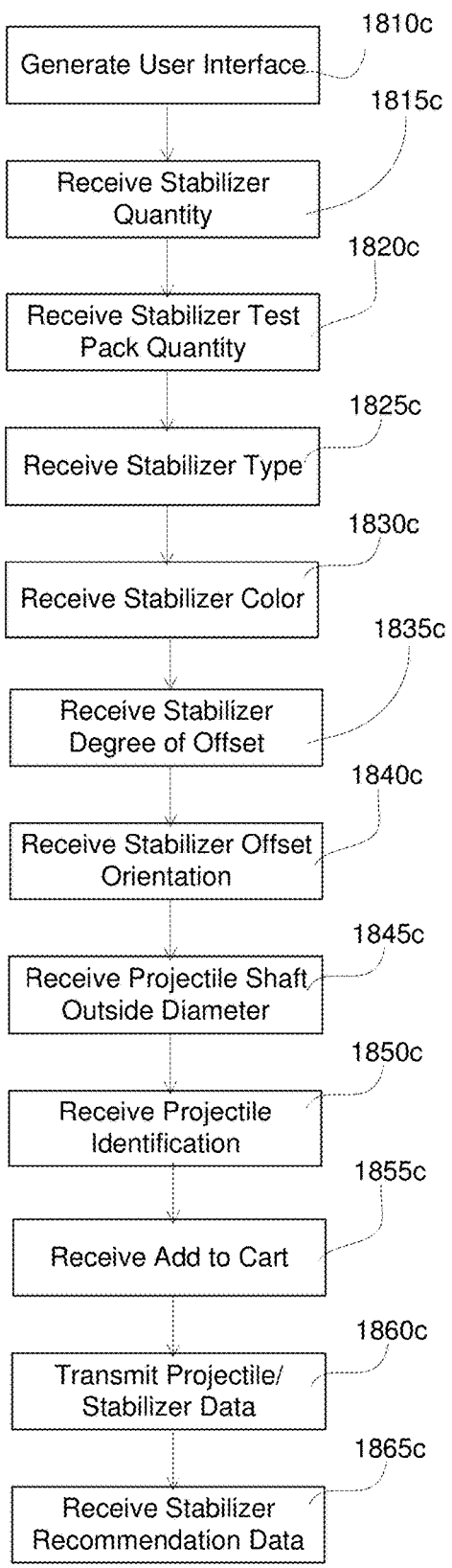

As illustrated in FIG. 18B, a customer device 1805*b* may include a user interface generation module 1810*b*, a stabilizer quantity receiving module 1815*b*, a stabilizer test pack quantity receiving module 1820*b*, a type of stabilizer receiving module 1825*b*, a stabilizer color receiving module 1830*b*, a stabilizer degree of offset receiving module 1835*b*, a stabilizer offset orientation receiving module 1840*b*, a projectile shaft outside diameter receiving module 1845*b*, a projectile identification receiving module 1850*b*, an add to cart receiving module 1855*b*, a projectile/stabilizer data transmission module 1860*b*, and a stabilizer recommendation determination data receiving module 1865*b*, for example, stored on a memory 1887*b* as a set of computer-readable instructions. In any event, the modules 1810*b*-1865*b* may be similar to, for example, the module 1888*a* of FIG. 18A.

The network interface 1889*a* may be configured to facilitate communications between a customer device 1805*a,b* and a remote device 1895*a,d* via any wireless communication network 1870*a*, including for example a wireless LAN, MAN or WAN, WiFi, the Internet, or any combination thereof. Moreover, a customer device 1805*a,b* may be communicatively connected to a remote device 1895*a,d* via any suitable communication system, such as via any publicly available or privately owned communication network, including those that use wireless communication structures, such as wireless communication networks, including for example, wireless LANs and WANs, satellite and cellular telephone communication systems, etc. A customer device 1805*a,b* may cause, for example, projectile and/or stabilizer related data to be transmitted to, and stored in, for example, a remote device 1895*a,d*, memory 1897*a,d*, and/or a remote projectile and fletch related database 1893*a*.

A remote device 1895*a,d* may include a user interface 1894*a*, a memory 1897*a,d*, and a processor 1896*a* for storing and executing, respectively, a module 1898*a*. The module 1898*a*, stored in the memory 1897*a,d* as a set of computer-readable instructions, may facilitate applications related to automatically generating at least one stabilizer, stabilizer related information, and/or a stabilizer shipping label. The module 1898*a* may also facilitate communications between the remote device 1895*a,d* and a customer device 1805*a,b* via a network interface 1892*a*, and the network 1870*a*, and other functions and instructions.

A remote device 1895*a,d* may be communicatively coupled to a projectile and fletch related database 1893*a*. While the projectile and fletch related database 1893*a* is shown in FIG. 18A as being communicatively coupled to the remote device 1895*a,d*, it should be understood that the projectile and fletch related database 1893*a* may be located within separate remote servers (or any other suitable computing devices) communicatively coupled to the remote device 1895*a,d*. Optionally, portions of projectile and fletch related database 1893*a* may be associated with memory modules that are separate from one another, such as a memory 1887*a,b* of a customer device 1805*a,b*.

Figure 18D:
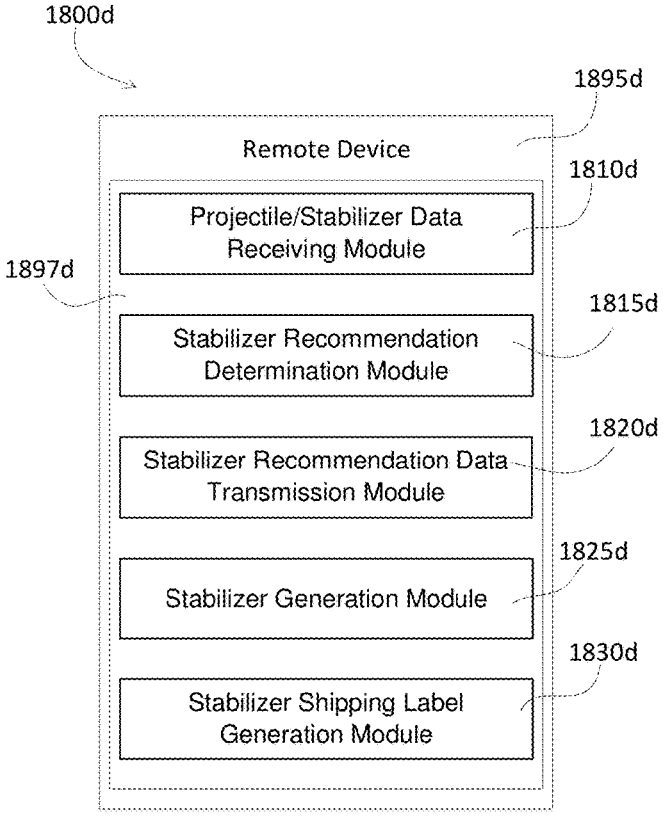
Figure 18E:
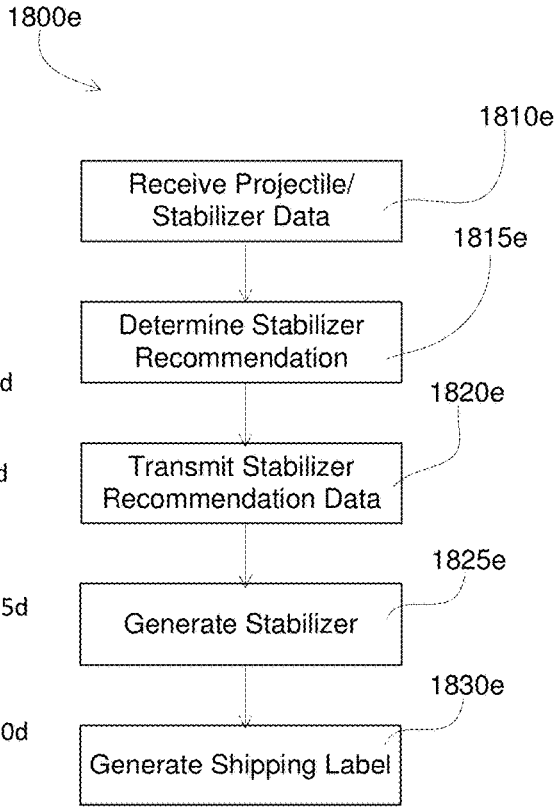

As illustrated in FIG. 18D, a remote device may include a projectile/stabilizer data receiving module 1810*d*, a stabilizer recommendation determination module 1815*d*, a stabilizer recommendation data transmission module 1820*d*, a stabilizer generation module 1825*d*, and a stabilizer shipping label generation module 1830*d*, for example, stored on a memory 1897*d* as a set of computer-readable instructions. In any event, the modules 1810*d*-1830*d* may be similar to, for example, the module 1898*a* of FIG. 18A.

As further illustrated in FIG. 18A, the system 1800*a* may include a 3D printer and a 2D printer. As described herein, the 3D printer may automatically generate at least one stabilizer. The 2D printer may automatically generate stabilizer information, projectile information, a shipping label, etc.

A method of automatically generating at least one stabilizer, stabilizer related information, and a stabilizer shipping label 1800*c,e* may be implemented by a first processor (e.g., processor 1886*a* of customer device 1805*a* of FIG. 18A) executing, for example, at least a portion of modules 1810*b*-1865*b* of FIG. 18B, and/or a second processor (e.g., processor 1896*a* of remote device 1895*a* of FIG. 18A) executing, for example, at least a portion of modules 1810*d*-1830*d* of FIG. 18D. In particular, processor 1886*a* may execute the user interface generation module 1810*b* to cause the processor 1886*a* to, for example, generate a user interface 1700*a-d* (block 1810*c*).

The processor 1886*a* may execute the stabilizer quantity receiving module 1815*b* to cause the processor 1886*a* to, for example, receive a stabilizer quantity via, for example, user interface 1700*a* (block 1815*c*). The processor 1886*a* may execute the stabilizer test pack quantity receiving module 1820*b* to cause the processor 1886*a* to, for example, receive a stabilizer test pack quantity via, for example, user interface 1700*c* (block 1820*c*). The processor 1886*a* may execute the type of stabilizer receiving module 1825*b* to cause the processor 1886*a* to, for example, receive a type of stabilizer via, for example, user interface 1700*a* (block 1825*c*). The processor 1886*a* may execute the stabilizer color receiving module 1830*b* to cause the processor 1886*a* to, for example, receive a stabilizer color via, for example, user interface 1700*a,c* (block 1830*c*).

The processor 1886*a* may execute the stabilizer degree of offset receiving module 1835*b* to cause the processor 1886*a* to, for example, receive a stabilizer degree of offset via, for example, user interface 1700*a* (block 1835*c*). The processor 1886*a* may execute the stabilizer offset orientation receiving module 1840*b* to cause the processor 1886*a* to, for example, receive a stabilizer offset orientation via, for example, user interface 1700*a,c* (block 1840*c*). The processor 1886*a* may execute the projectile shaft outside diameter receiving module 1845*b* to cause the processor 1886*a* to, for example, receive a projectile shaft outside diameter via, for example, user interface 1700*a,c* (block 1845*c*).

The processor 1886*a* may execute the projectile identification receiving module 1850*b* to cause the processor 1886*a* to, for example, receive a projectile identification via, for example, user interface 1700*a,c* (block 1850*c*). The processor 1886*a* may execute the add to cart receiving module 1855*b* to cause the processor 1886*a* to, for example, receive an add to cart input via, for example, user interface 1700*a,c,d* (block 1855*c*). The processor 1886*a* may execute the projectile/stabilizer data transmission module 1860*b* to cause the processor 1886*a* to, for example, transmit projectile/stabilizer data from, for example, a customer device 1805*a,b* to a remote device 1895*a,d* (block 1860*c*). The processor 1886*a* may execute the stabilizer recommendation determination data receiving module 1865*b* to cause the processor 1886*a* to, for example, receive stabilizer recommendation determination data from, for example, a remote device 1895*a,d* (block 1865*c*).

The processor 1896*a* may execute the projectile/stabilizer data receiving module 1810*d* to cause the processor 1896*a* to, for example, receive projectile/stabilizer data from a customer device 1805*a,b* (block 1810*e*). The processor 1896*a* may execute the stabilizer recommendation determination module 1815*d* to cause the processor 1896*a* to, for example, determine a stabilizer recommendation based on, for example, any one of a stabilizer quantity 1706*a*, a stabilizer test pack quantity 1718*c*, a type of stabilizer 1707*a*, a stabilizer color 1708*a*/1719*c*, a degree offset 1709*a*, an offset orientation 1710*a*/1720*c*, a projectile shaft outside diameter 1711*a*/1721*c*, a projectile manufacturer 1712*a*/1722*c*, a stabilizer material, an associated operating temperature (or temperature range), any subcombination thereof, or combination thereof (block 1815*e*).

The processor 1896*a* may execute the stabilizer recommendation data transmission module 1820*d* to cause the processor 1896*a* to, for example, transmit projectile/stabilizer data from, for example, a customer device 1805*a,b* to a client device 1805*a,b* (block 1820*e*). The processor 1896*a* may execute the stabilizer generation module 1825*d* to cause the processor 1896*a* to, for example, control the 3D printer 1830*a* to print at least one stabilizer 115*a,b*/215/300*a-d*-1600*a-d* (block 1825*e*). The processor 1896*a* may execute the stabilizer shipping label generation module 1830*d* to cause the processor 1896*a* to, for example, control the 2D printer 1826*a* to print projectile related information, stabilizer related information, and/or a shipping label (block 1830*e*).

While not shown in FIG. 1A, 1B or 2, any given projectile may include a stop disposed (e.g., at a trailing end of a shaft of a projectile) for captivating a stabilizer during the flight of the projectile. In the embodiment shown, the stop may comprise a plurality of threads for mating with a corresponding recess in a trailing end of a shaft of a projectile (not shown), at least one taper (or barb, "ramp," or other projection) adapted to impede gradually the travel of a stabilizer, at least one projection adapted to prevent the travel of a stabilizer beyond the projections, and a captivating region that may comprise two opposing non-tapered projections disposed adjacent to the projections where the stabilizer can remain captive, and may further comprise a socket adapted to receive a nock engaged (e.g., threadably) therewith. The taper may be sized to have a diameter that increases from a diameter smaller than that of the shaft receptacle to a diameter equal to or greater than that of the shaft receptacle, and thereby gently slows the travel of the stabilizer as it passes through the shaft receptacle and provides a "soft" stop to captivate the stabilizer during flight. In contrast, the projections may provide a "hard" stop beyond which the stabilizer cannot travel, which feature may be significant at such time as the projectile impact is made with a target, as follows: the outermost portions of the projections may be sized so as to have a diameter equal to or slightly smaller than that of the shaft receptacle, such that upon impact, the projections may mate with the shaft receptacle to secure the stabilizer onto the stop, and the stabilizer can thus prevent the trailing end of the projectile from passing through the target (e.g., a game animal). It is noted that a captivating region may therefore be provided, comprising one or more projections with outermost portions sized so as to have a diameter slightly smaller than the shaft receptacle, to provide a region in which the stabilizer can remain captive by friction or interference fit or other mechanical means. Alternatively, in a scenario in which it is desirable for the projectile to be able to pass through the target, the stop and/or stabilizer could comprise means for releasing the stabilizer from the stop (e.g., a stop could be formed without any projections), such that the projectile can pass through the target and the stabilizer and/or stop may drop to the ground after the projectile completes its travel through the shaft receptacle of the stabilizer. A stabilizer and a stop in use during the flight of an exemplary projectile having no fletching affixed to its shaft. Prior to the projectile being propelled from a bow (not shown), the stabilizer, which may be adapted to slide along the shaft, may be positioned around the shaft at the leading end of the projectile, just beyond a tip. The projectile may then be drawn back prior to launch, and the stabilizer may remain loosely captivated at the front of the projectile shaft. The projectile is then launched. As the projectile begins to leave the bow after the string is released, the stabilizer may slide along the shaft toward the trailing end of the projectile as the projectile travels through the shaft receptacle of the stabilizer. The travel of the stabilizer occurs as a result of the substantially slower rate of acceleration of the stabilizer with respect to that of the projectile, due to low friction with the projectile, the natural resistance of the stabilizer to begin movement, and wind and/or air resistance.

A stabilizer positioned along the shaft of the projectile in flight, shortly after the projectile is propelled, as the projectile travels forward through the stabilizer and the stabilizer travels toward the trailing end of the projectile. A projectile may slide forward through the stabilizer until contact is made with the stop, with which the stabilizer engages, causing the stabilizer to remain captive at the trailing end of the projectile for the duration of the flight, thereby providing controlled stabilization, spin, and/or other flight characteristics (e.g., wobble or longitudinal compression of the projectile).

When the stabilizer is positioned at the leading end of the projectile prior to flight, the projectile may be launched in a conventional manner, except for the conventional nock position on the bowstring. In contrast, with conventional projectiles, the nock must be positioned in a particular orientation or relationship to the fletching and string. A projectile equipped with a stabilizer consistent with the present invention needs no particular orientation or clocking, since there is no risk of the stabilizer interfering with the projectile rest or any other part of the bow.

The elimination of conventional fletching tail feathers from the body of projectiles, as achieved by the present invention, allows for easy storage of projectiles without causing damage to stabilizing surfaces. Typical fletched projectiles are delicate and easily become damaged when stored or when used in the field. A stabilizer consistent with the present invention may simply be removed from the projectile and the bare projectile shaft stored without the possibility of fletching damage. Further, a damaged fletching unit may be replaced in the field in seconds, without any loss of accuracy or repeatability. Additionally, since the stabilizer is mechanically fixed to the projectile during flight and does not require gluing, the use of toxic glues and other chemicals can be reduced by way of the present invention.

Various changes may be made in the foregoing invention without departing from the spirit and scope thereof. For example, it is noted that the stop may be located so as to captivate the stabilizer at the trailing end of the projectile shaft, or alternatively, at another location along the shaft selected to optimize projectile flight for a given application, e.g., for balance, stability, or shootability of the projectile. When the stabilizer is disposed as closely as possible to the trailing end of the projectile, the center of the stabilizing force can be situated rearward beyond that of convention fletching and closer to the trailing end of the projectile shaft than possible with conventional fletching. Since the stabilizing force or equivalent center of pressure caused by the stabilizer of the present invention may be positioned rearward beyond that of conventional vanes, the force required to produce an equivalent stabilization force decreases, and thus, the total surface area required to produce an equivalent force is reduced. The projectile speed is increased over conventionally fletched projectiles due to less frictional drag as a result of the reduced surface area required for stabilization. Further, the decrease in the cross sectional area of the stabilizing surface, as compared to conventional vanes, results in less cross wind drift and improved accuracy when shooting in cross winds.

With conventional bow and/or projectile rest designs, it is desirable for the stabilizer to be positioned over the leading end of the projectile shaft and positioned at a close distance from the leading end of the projectile prior to launch, so as not to obstruct the tip of projectile. It is, however, contemplated that the stabilizer may, alternatively, be fixed along the shaft at a given location, instead of being slidably disposed along the shaft. Such fixation may either be permanent (e.g., gluing) or temporary (e.g., engagement with a stop, as described hereinabove). An exemplary such application would be the use of the stabilizer consistent with the invention with a bow having offset projectile guides, projectile rests, or fall-away rests, wherein the stabilizer can begin flight disposed at the trailing end of a projectile. Thus, the stabilizer of the present invention solves the interference issue for all bows in use, even specialized bows and projectile rests already adapted to minimize interference with fletching, and users of such specialized bows and projectile rests may enjoy the same benefits of the present invention as users of conventional bow rests. More than one stabilizer may be used for certain applications (e.g., a fixed stabilizer at one location along a shaft and a sliding stabilizer elsewhere along the shaft).

It should be understood that a stop consistent with the separate component from the nock and/or shaft, or alternatively, may be integrated into either the nock, the shaft, or both. Since the trailing ends of many conventional projectile shafts are already adapted to receive a nock therein (e.g., via a threaded recess), it is contemplated that a threaded stop could be installed in its place. Thus, if the stop is constructed to have a similar adapter for receiving a nock therein (e.g., a threaded recess), a conventional nook could be removed from a projectile shaft and replaced by a stop, and then the nock could easily be installed directly into the stop. Of course, a stop consistent with the present invention could alternatively comprise a nock or similar device formed therein, and a nock consistent with the present invention could alternatively comprise a stop device. It should further be recognized that a stop mechanism could be integrated into a projectile shaft and may merely comprise a single taper, O-ring, or similar feature located along the shaft and appropriately sized to captivate the stabilizer. A stop mechanism may comprise a projectile having a shaft with a tapered portion formed such that the shaft has an increasingly larger diameter toward its trailing end, to captivate the stabilizer.

As those skilled in the art will recognize, while the exemplary stabilizer 200 illustrated and described hereinabove comprises a pair of nested annular structures, a stabilizer consistent with the present invention may comprise a variety of other shapes, sizes and configurations. For example, the circumferentially extending wing might comprise a square, rectangular, ovular, or other cross section instead of a circular cross-section. Alternatively, instead of a circumferentially extending wing, a plurality of arcuate or straight wing sections not connected to one another might serve as wings, wherein each section is held onto a central annular structure by means of one or more fins or other support members.

The central annular structure of the stabilizer and the shaft receptacle formed therein could alternatively comprise other configurations for mating with the shaft of a projectile, such as a plurality of arcuate sections or inward projections on the stabilizer appropriately sized for mating with the shaft. The mating of stabilizer and shaft could also be accomplished through a number of alternative means, a groove or track configuration, wherein a groove or ridge 480 is formed in or on the shaft of the projectile along its length, and an element (e.g., a groove, notch or projection) adapted to mate with and slide within or along the groove or ridge projects from or is formed in the stabilizer.

While three fins generally provide maximum stability without adding too much weight to the stabilizer and projectile, it should be recognized that the fins of the stabilizer can vary in number, shape, size, angular disposal, and other aspects, and certain embodiments of the stabilizer might not even include any fins. The angle(s) at which the fins are mounted may also vary, e.g., various embodiments may include fins angularly fixed relative to the longitudinal axis of the projectile to provide rotational spin force to the projectile; fins fixed parallel to the longitudinal axis of the projectile to prevent the spin of the projectile, e.g., to improve penetration of the projectile into the target; or alternatively, fins fixed parallel to the longitudinal axis of the projectile with an expanding taper design terminating at the trailing edge of the fin to produce rotational spin. Thus, a user can change the flight characteristics from a spinning projectile, which is similar to a bullet shot from a rifled barrel, to a non-spinning projectile, for better target penetration when using certain tips. It is further noted that the number, size and shape of stabilizing fins attached to the stabilizer may vary without interference concerns at the projectile rest or other portions of the bow. Cross-sections of the fins at certain locations thereon may have varying shapes (e.g., airfoil-shaped or tapering cross-sections, to effect various modifications in flight). The fins may be formed with one or more apertures therein, to reduce the weight of the stabilizer and/or for reasons of aerodynamics (e.g., drift due to side wind, flight due to right rotation, flight path due to left rotation, etc.).

The projections or "fingers" of the stabilizer that create a friction or interference fit between the projectile shaft and the stabilizer during slideable engagement therebetween could alternatively comprise other configurations (e.g., a taper, or a single projection in the form of a flexible O-ring). Such projections, tapers, fingers, O-rings, or similar self-adjustment or self-centering features may further be adapted to permit a single stabilizer to be used with a variety of projectiles having shafts of varying dimensions, tolerances, or other characteristics (e.g., by construction using a flexible material), such that the projections expand or contract to create a friction or interference fit with projectile shafts having varying diameters, or even shafts having cross-sections other than circular.

Materials for constructing a stabilizer and/or stop consistent with the present invention may include one or more metals, e.g., aluminum, or plastics such as nylon, polyethylene, or polypropylene. Such a stabilizer and/or stop may be manufactured as a one-piece unit or other multi-piece designs, and may be flexible, rigid, semi-rigid, or comprise components of differing materials or having differing rigidity. The stabilizer and/or stop may be made in a variety of varying lengths, colors, and configurations, and may be manufactured by a number of techniques, e.g., as injection molding. The stabilizer and/or stop may comprise luminescent, bioluminescent, electro-luminescent, or photo-luminescent materials for ease of visibility and retrieval, particularly in dark or dull-colored environments.

Those skilled in the art will recognize that a stabilizer consistent with the present invention has utility not only in the field of archery, but may also have utility in improving the flight of other types of projectiles, e.g., a javelin or an atlatl (a device that is used to throw with considerable mechanical advantage a lightweight spear called a dart). It is further noted that a projectile used in conjunction with a stabilizer consistent with the present invention does not necessarily have to be one adapted for air travel, but instead could be a projectile for travel in water (e.g., for bowfishing or spearfishing), or another liquid or gaseous media.

It is further contemplated that various toolsets or kits may be provided, wherein the sets of tools comprise one or more of the following: one or more stabilizers, one or more stops, one or more nocks, one or more projectile shafts, and one or more projectiles. For example, a toolset might comprise a projectile (or just a shaft) and a corresponding sliding stabilizer adapted for travel along the projectile and/or shaft; or a stabilizer and a corresponding stop; or a projectile (or just a shaft) and a stop adapted for engagement with the shaft. Further, a set of stabilizers having differing dimensions from one another may be provided (differing in, e.g., diameter of the circumferentially extending wing, angular configuration of the fins, diameter of the central shaft receptacle, length of the projections formed in the central shaft receptacle), which may have utility, e.g., when using projectile shafts having differing diameters. Further, a set of stabilizers could comprise a plurality of differently colored stabilizers for ease of individual identification.

An annular arrow fletch may be set on its base slightly tilted toward the viewer to allow for an offset overview of the invention. This drawing allows for an overview of two of the three fins, the micro-grooves and the metal contact on or in the central elongated cylindrical cylinder cap.

An annular arrow fletch may be set on its base tilted toward the right at a 45-degree angle allowing the viewer an offset overview of the invention. This drawing allows for an overview of two of the three fins, the micro-grooves depicted but partially obstructed by the annular wing and the metal contact placement on or in the central elongated cylindrical cylinder cap. The recess at the top of center elongated cylindrical cylinder cap is the placement of the arrow nock. The central elongated cylindrical cylinder cap partially encloses the top of the center elongated cylindrical cylinder to prevent the arrow shaft from completely passing through the central center elongated cylindrical cylinder structure.

A conventional arrow comprises a tip, a shaft, and a prior art stabilization system comprising a plurality of glued fins as feathers, veins and or fletching's. The fins are fixed to the shaft and are easily damaged or lost through contact with other surfaces, e.g., with the bow used to launch the arrow or with butt material (backing, bales, man made targets or dirt designed to stop and hold arrows) of a paper target, or with a game animal when hunting. The aft end of the arrow may comprise a recess (not shown) formed therein for engagement (e.g., via a interference fit) with an arrow nock that secures the arrow in place on a bowstring before launch, e.g., by disposing an arrow nocked to a bowstring (not shown) within a notched area of the arrow nock.

An exemplary annular arrow fletch in one embodiment of the present invention is illustrated. The annular arrow fletch is field replaceable, reduces assembly labor cost, and significantly improves the stability of arrows. In the embodiment shown, the annular arrow fletch comprises an annular wing, pluralities of fins, a central elongated cylindrical cylinder structure recess formed within a central elongated cylindrical cylinder structure cap, the central elongated cylindrical cylinder structure which is smooth walled formed within the aperture of the annular wing. In addition to providing stability, the annular wing may further be adapted to add rigidity to and/or to direct air to the fins. The fins have a multiple functions; the fins have micro-grooves on one side serving both as aerodynamic elements and structural elements bridging the annular wing and the central elongated cylindrical cylinder structure. The exemplary annular arrow fletch shown is designed to replace conventional fletching, i.e., to be used with an arrow having no other form of fletching. The central elongated cylindrical cylinder structure of the annular arrow fletch is sized to have a diameter larger than that of the shaft of an arrow, so that the arrow shaft can be slid therein. The smooth interior walls of the central elongated cylindrical cylinder structure of the invention allow for a semi interference fit with the arrow shaft. The interference fit with the arrow shaft is not required for the annular arrow fletch to function. Once the aft end of the arrow shaft is inserted into the central elongated cylindrical cylinder structure of the annular arrow fletch the shaft will recess to a predetermined depth and engage, making contact with the underside of the elongated cylindrical cylinder structure cap. The opening in the aft end of the arrow shaft will align with the recess opening in the central elongated cylindrical cylinder structure cap and the arrow nock or lighted arrow nock can be inserted into the central elongated cylindrical cylinder structure cap recess. Arrow nocks or lighted arrow nocks are designed to have an interference fit with the inside of an arrow shaft. The interference fit will hold the annular arrow fletch in position preventing any movement but allowing the airfoil effects to be imparted onto the arrow in flight. With reference to central elongated cylindrical cylinder structure cap recess, is sized to have a smaller diameter than that of the central elongated cylindrical cylinder structure and provides a predetermined depth engagement to the annular arrow fletch with the arrow shaft. Alternatively, in a scenario in which it is desirable for the arrow to be able to pass through the target, the interference fit of the arrow nock and the interior of the arrow shaft allows for the means for releasing the annular arrow fletch such that the arrow shaft can pass through the target and the annular arrow fletch and arrow nock will drop to the ground after the arrow shaft completes its travel through the central elongated cylindrical cylinder structure of the annular arrow fletch.

The annular arrow fletch is positioned around the arrow shaft at the aft end of the arrow shaft, the arrow may be launched in a conventional manner, the conventional arrow nock positioned on the bowstring. The arrow is then drawn back prior to launch, and the annular arrow fletch remains affixed at a predetermined depth on the aft end of the arrow shaft. The archer releases the bowstring with either a mechanical release or with their fingers and the arrow is then launched. As the arrow begins to leave the bow the forward projection of the annular arrow fletch begins to direct wind and/or air resistance. As the arrow travels forward through the arrow drop away rest, for the duration of the flight, thereby providing controlled stabilization, spin, and/or other flight characteristics, e.g., reduced wobble or oscillation of the arrow. The annular arrow fletch is made of more rigid materials then traditional feathers, vane or fletching materials and imparts corrective forces onto the arrow shaft as soon as the arrow nock is leaves the string. Because of the use of more rigid materials the annular arrow fletch can only be shot from properly tuned bows with fall away rests with appropriated clearance.

In contrast, with conventional arrows, the arrow nock must be positioned in a particular orientation or relationship to the fletching, arrow rest and string. An arrow equipped with an annular arrow fletch consistent with the present invention needs no particular orientation or clocking, since there is no risk of the annular arrow fletch annular wing interfering with a fall away arrow rest or any other part of the bow when sufficient clearance has been confirmed prior to shooting an arrow with an annular arrow fletch installed.

The elimination of conventional fletching, tail feathers from the body of arrow shaft, as achieved by the present invention, allows for easy storage of arrows without causing damage to stabilizing surfaces. Typical fletched arrows are delicate and easily become damaged when stored or when used in the field. An annular arrow fletch consistent with the present invention may simply be removed from the arrow shaft and the bare arrow shaft stored without the possibility of fletching damage. Further, a damaged fletching unit may be replaced in the field in seconds, without any loss of accuracy or repeatability. Additionally, since the annular arrow fletch is arrow nock fixed to the arrow during flight and does not require arrow nock pins, the use of toxic glues and other chemicals can be reduced by way of the present invention.

Various changes may be made in the foregoing invention without departing from the spirit and scope thereof. For example, fin tapper or angle to optimize arrow flight for a given application, e.g., for balance, stability, or shoot-ability of the arrow. When the annular arrow fletch is disposed as closely as possible to the trailing end of the arrow shaft, the center of the stabilizing force can be situated rearward beyond that of convention fletching and closer to the aft end of the arrow shaft than possible with conventional fletching. Since the stabilizing force or equivalent center of pressure caused by the annular arrow fletch of the present invention may be positioned rearward beyond that of conventional vanes, the force required to produce an equivalent stabilization force decreases, and thus, the total surface area required to produce an equivalent force is reduced. The arrow speed is increased over conventionally fletched arrows due to less frictional drag as a result of the reduced surface area required for stabilization. Further, the decrease in the cross sectional area of the stabilizing surface, the annular wing as compared to conventional vanes, results in less cross wind drift and improved accuracy when shooting in cross winds.

With conventional bow and/or arrow drop away rest designs, it is desirable for the annular arrow fletch to be positioned at the aft end of the arrow shaft and positioned at the end of the arrow prior to launch, so as not to be obstructed by the drop away rest in flight as the arrow passes over the arrow rest. Thus, the annular arrow fletch of the present invention solves the interference issue for all bows in use, even specialized bows and arrow rests already adapted to minimize interference with conventional fletching, and users of such specialized bows and drop away arrow rests may enjoy the same benefits of the present invention as users of conventional bow with drop away rests.

As those skilled in the art will recognize, while the exemplary annular arrow fletch illustrated and described herein above comprises a pair of nested annular structures, an annular arrow fletch consistent with the present invention may comprise a variety of other shapes, sizes and configurations. For example, the annular wing might comprise a square, rectangular, ovular, or other cross section instead of a circular cross-section. Alternatively, instead of an annular wing, a plurality of arcuate or straight wing sections not connected to one another might serve as wings, wherein each section is held onto a central elongated cylindrical cylinder structure by means of one or more fins or other support members.

The central elongated cylindrical cylinder structure of the annular arrow fletch and the cylindrical smooth walls formed therein could alternatively comprise other configurations for forming the interference fit with the shaft of an arrow, such as; a plurality of arcuate sections or inward projections on the central elongated cylindrical cylinder appropriately sized for mating with the shaft. The annular arrow fletch central elongated cylindrical cylinder annular structure smooth wall interference fit and the arrow shaft could also be accomplished through a number of alternative means, such as; a groove or track configuration, wherein a groove or ridge is formed in or on the shaft of the arrow along its length, and an element (e.g., a groove, notch or projection) adapted to mate with and slide within or along the groove or ridge projects from or is formed in the annular arrow fletch.

While three fins generally provide maximum stability without adding too much weight to the annular arrow fletch and arrow, it should be recognized that the fins of the annular arrow fletch can vary in number, shape, size, angular disposal, and other aspects, and certain embodiments of the annular arrow fletch might not even include any fins. The angle(s) at which the fins are mounted may also vary, e.g., various embodiments may include fins angularly fixed relative to the longitudinal axis of the arrow to provide rotational spin force to the arrow; fins fixed parallel to the longitudinal axis of the arrow to prevent the spin of the arrow, e.g., to improve penetration of the arrow into the target; or alternatively, fins fixed parallel to the longitudinal axis of the arrow with an expanding taper design terminating at the trailing edge of the fin to produce rotational spin. Thus, a user can change the flight characteristics from a spinning arrow, which is similar to a bullet shot from a rifled barrel, to a non-spinning arrow, for better target penetration when using certain tips. It is further noted that the number, size and shape of stabilizing fins attached to the annular arrow fletch may vary without interference concerns at the drop away arrow rest or other portions of the bow. Cross-sections of the fins at certain locations thereon may have varying shapes, e.g., airfoil-shaped, micro-groves or tapering cross-sections, to effect various modifications in flight. The fins may be formed with one or more apertures therein, to reduce the weight of the annular arrow fletch and/or for reasons of aerodynamics.

The central elongated cylindrical cylinder interior smooth wall of the annular arrow fletch that create a loose interference fit between the arrow shaft and the central elongated cylindrical cylinder structure during installation engagement there between could alternatively comprise other configurations, e.g., a taper, or a single projection in the form of a flexible O-ring. Such projections, tapers, fingers, O-rings, or similar self-adjustment or self-centering features may further be adapted to permit a single annular arrow fletch to be used with a variety of arrows having shafts of varying dimensions, tolerances, or other characteristics, e.g., by construction using a flexible material, such that the projections expand or contract to create a friction or interference fit with arrow shaft(s) having varying diameters, or even shafts having cross-sections other than circular.

Materials for constructing an annular arrow fletch consistent with the present invention may include one or more metal contacts, e.g., aluminum, brass, stainless steel, steel, copper, conductive ink, conductive paint and the body of the invention made of plastics such as; nylon, acrylic, polyethylene, or polypropylene. Such an annular arrow fletch may be manufactured as a one-piece unit or other multi-piece designs, and may be flexible, rigid, semi-rigid, or comprise components of differing materials or having differing elasticity and rigidity. The annular arrow fletch may be made in a variety of varying lengths, colors, and configurations, and may be manufactured by a number of techniques, e.g., as injection molding, tooled, and or 3-D printing. The annular arrow fletch may comprise luminescent, bioluminescent, electro-luminescent, or photo-luminescent materials for ease of visibility and retrieval, particularly in dark or dull-colored environments.

Those skilled in the art will recognize that an annular arrow fletch consistent with the present invention has utility not only in the field of archery, but may also have utility in improving the flight of other types of projectiles, e.g., a javelin or an atlatl (a device that is used to throw with considerable mechanical advantage a lightweight spear called a dart). It is further noted that a projectile used in conjunction with an annular arrow fletch consistent with the present invention does not necessarily have to be one adapted for air travel, but instead could be a projectile for travel in water (e.g., for bow fishing or spearfishing), or another liquid or gaseous media.

A set of annular arrow fletch having differing dimensions from one another may be provided (differing in, e.g., diameter of the annular wing, angular configuration of the fins, diameter of the central elongated cylindrical cylinder structure, length of the central elongated cylindrical cylinder, which may have utility, e.g., when using arrow shafts having differing diameters. Further, a set of annular arrow fletch could comprise a plurality of differently colored annular arrow fletch for ease of individual identification.

Although the present invention has been set forth in terms of the embodiments described herein, it is to be understood that such disclosure is purely illustrative and is not to be interpreted as limiting. Consequently, without departing from the spirit and scope of the invention, various alterations, modifications, and or alternative applications of the invention will, no doubt, be suggested to those skilled in the art after having read the preceding disclosure. For example, the annular arrow fletch annular cross-sections may be tapered to have inner diameters that narrow along the respective lengths of the annular arrow fletch central elongated cylindrical cylinder. Also, if desired, one or more apertures may be formed in the fins. And the annular wing need not be circular, but may be ovular, airfoil-shaped and or tapered in cross-section.

A stabilizer may be manufactured using a thermoplastic Polyurethanes (TPU) in a fused filament fabrication (FFF), or fused deposition modeling (FDM), manufacturing process. FDM and FFF may involve extrusion of melted material (thermoplastic polymers) being deposited in a predetermined path layer-by-layer, typically, originating from a roll of filament (e.g., SainSmart TPU filament). The filament may be high strength and flexible. Each spool of TPU filament may include 0.8 kg/1.76 lb of material. The filament may be drawn out to a diameter of 1.75 mm with a dimensional accuracy of +/−0.05 mm, Recommended printer settings may include: print Nozzle, 0.4-0.8 mm; extruder temperature, 195-230° C.; print bed temperature, 40-60° C.; and cooling Fan, On.

A stabilizer may be used on a self-propelled projectiles, arrows, crossbow bolts, spears, javelins, jarts, blowgun darts, throwing darts, toy rockets, toy projectiles etc. The compression feature of our product allows it to affix itself to the projectile being thrown, fired, shot, launched, flung etc. The compression feature of our product is due to the fact that the measurement and fit of the inside diameter of the stabilizer is slightly less than the measurement of the outside diameter of the projectile to which it is affixed to.

A stabilizer may include a variation of colors including but not limited to glow, orange, blue, red, purple, green, white, black, pink, violet.

A stabilizer may not be glued on a shaft. In fact, a stabilizer may be configured to pop off/slide off upon impact/pass through marking the point of impact and/or shot depending on the projectile being utilized.

Although the present invention has been set forth in terms of the embodiments described herein, it is to be understood that such disclosure is purely illustrative and is not to be interpreted as limiting. Consequently, without departing from the spirit and scope of the invention, various alterations, modifications, and/or alternative applications of the invention will, no doubt, be suggested to those skilled in the art after having read the preceding disclosure. A stabilizer annular cross-sections may be tapered to have inner diameters that project along their respective lengths of the stabilizer. Also, if desired, one or more apertures may be formed in the fins. A circumferentially extending wing need not be circular, but may be ovular, airfoil-shaped and or tapered in cross-section. Accordingly, it is intended that the following claims be interpreted as encompassing all alterations, modifications, or alternative applications as fall within the true spirit and scope of the invention.

What is claimed is:

1. A stabilizer for a projectile, the stabilizer comprising:

a projectile shaft receptacle having an inside diameter that is less than an outside diameter of the projectile shaft prior to the projectile shaft being received within the projectile shaft receptacle, wherein the stabilizer includes a plurality of fins oriented with respect to a central axis such that the stabilizer encourages projectile rotation about the central axis when the projectile is projected, and wherein a breakaway coefficient of friction between an inner surface of the projectile shaft receptacle and an outer surface of the projectile shaft is above a rotational force that the stabilizer exerts on the projectile shaft when the projectile is projected, and wherein the stabilizer further comprises a mating feature adapted to engage said stabilizer with a projectile having a corresponding mating feature.

2. The stabilizer as claimed in claim 1, wherein the mating feature of said stabilizer has an annular cross-section, and wherein a rotational force exerted by a stabilizer on an associated projectile is a function of a surface area of an inner surface of a projectile shaft receptacle in combination with a value of a breakaway coefficient of friction, between the inner surface of the projectile shaft receptacle and an outer surface of an associated projectile shaft.

3. The stabilizer as claimed in claim 1, wherein the mating feature of said stabilizer comprises an annular wing and at least one projection adapted to cause a friction or interference fit with said projectile, said projection protruding in an inward direction with respect to said annular wing.

4. The stabilizer as claimed in claim 3, wherein said at least one projection comprises an O-ring.

5. The stabilizer as claimed in claim 3, wherein the mating feature of said stabilizer has an annular cross-section having an inner diameter; wherein said at least one projection comprises a plurality of projections protruding in an inward direction with respect to said annular wing; and wherein the innermost points of each of said projections all lie along a circle having a smaller diameter than the inner diameter of the annular cross-section of the mating feature.

6. The stabilizer as claimed in claim 3, comprising at least three fins.

7. The stabilizer as claimed in claim 3, wherein each fin is disposed substantially orthogonally with respect to said annular wing.

8. The stabilizer as claimed in claim 6, wherein at least a portion of said fin comprises a substantially tapered cross section.

9. The stabilizer as claimed in claim 6, further comprising a mating feature adapted to engage said stabilizer with a projectile having a corresponding mating feature; wherein said fin bridges said annular wing and the mating feature of said stabilizer.

10. The stabilizer as claimed in claim 2, wherein said stabilizer has a plurality of said annular cross-sections having inner diameters that projectile along the length of said mating feature.

11. The stabilizer as claimed in claim 6, wherein said annular wing has a longitudinal axis, wherein said fin is disposed at an angle with respect to said annular wing, said angle being selected to provide a predetermined amount of rotation about the central axis of said stabilizer when said stabilizer is engaged with a projectile.

12. The stabilizer as claimed in claim 6, wherein said fin comprises at least one aperture formed therein and/or wherein said plurality of fins comprises three fins.

13. The stabilizer as claimed in claim 3, wherein at least a portion of said annular wing has a substantially tapered cross-section.

14. The stabilizer as claimed in claim 1, wherein said stabilizer is adapted to engage slideably with a projectile.

15. The stabilizer as claimed in claim 1, wherein at least a portion of said stabilizer comprises a luminescent material.

16. A stabilizer for a projectile, the stabilizer comprising:

a pair of nested annular structures, each said structure having a substantially circular cross-section; and at least one support member bridging said nested annular structures; and a projectile shaft receptacle having an inside diameter that is less than an outside diameter of the projectile shaft prior to the projectile shaft being received within the projectile shaft receptacle, wherein the stabilizer includes a plurality of fins oriented with respect to a central axis such that the stabilizer encourages projectile rotation about the central axis when the projectile is projected, and wherein, a rotational force exerted by a stabilizer on an associated projectile is a function of a surface area of an inner surface of a projectile shaft receptacle in combination with a value of a breakaway coefficient of friction, between the inner surface of the projectile shaft receptacle and an outer surface of an associated projectile shaft.

17. A projectile, comprising:

a shaft having a leading end and a trailing end; and a stabilizer comprising a circumferentially extending wing, said stabilizer slidably disposed on or fixed to said shaft; and a projectile shaft receptacle having an inside diameter that is less than an outside diameter of the projectile shaft prior to the projectile shaft being received within the projectile shaft receptacle, wherein the stabilizer includes a plurality of fins oriented with respect to a central axis such that the stabilizer encourages projectile rotation about the central axis when the projectile is projected, and wherein a rotational force exerted by a stabilizer on an associated projectile is a function of a surface area of an inner surface of a projectile shaft receptacle in combination with a value of a breakaway coefficient of friction, between the inner surface of the projectile shaft receptacle and an outer surface of an associated projectile shaft.

18. The projectile as claimed in claim 17, wherein the stabilizer includes a plurality of fins oriented with respect to a central axis such that the stabilizer encourages projectile rotation about the central axis when the projectile is projected, and wherein a breakaway coefficient of friction between an inner surface of the projectile shaft receptacle and an outer surface of the projectile shaft is above a rotational force that the stabilizer exerts on the projectile shaft when the projectile is projected.

19. The projectile as claimed in claim 17, wherein said stabilizer is held onto the shaft by friction or interference fit.

* * * * *